US008948652B2

(12) United States Patent
Abe

(10) Patent No.: US 8,948,652 B2
(45) Date of Patent: Feb. 3, 2015

(54) IMAGE FORMING APPARATUS AND PROCESS UNIT THAT FORM IMAGES BY USING PHOTOSENSITIVE BODIES AND DEVELOPING UNITS

(75) Inventor: Koji Abe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 219 days.

(21) Appl. No.: 13/426,756

(22) Filed: Mar. 22, 2012

(65) Prior Publication Data

US 2012/0308259 A1 Dec. 6, 2012

(30) Foreign Application Priority Data

May 30, 2011 (JP) ..... 2011-120498

(51) Int. Cl.
*G03G 21/18* (2006.01)

(52) U.S. Cl.
USPC ..... 399/112

(58) Field of Classification Search
CPC ..... G03G 15/0178; G03G 21/1676; G03G 21/1807; G03G 2215/0119; G03G 2221/1603; G03G 2221/1869
USPC ..... 399/54, 111, 112, 119, 223, 228
See application file for complete search history.

(56) References Cited

U.S. PATENT DOCUMENTS

| | | | | |
|---|---|---|---|---|
| 7,509,071 | B2 * | 3/2009 | Yoshimura et al. | 399/111 |
| 7,715,756 | B2 * | 5/2010 | Hattori | 399/119 |
| 7,885,562 | B2 * | 2/2011 | Wang et al. | 399/54 |
| 8,126,358 | B2 * | 2/2012 | Tomatsu | 399/113 |
| 8,260,171 | B2 * | 9/2012 | Matsuda | 399/110 |
| 8,290,395 | B2 * | 10/2012 | Uchida | 399/110 |
| 8,346,126 | B2 * | 1/2013 | Okabe | 399/111 |
| 8,396,392 | B2 * | 3/2013 | Takakuwa et al. | 399/111 |
| 2007/0280730 | A1 * | 12/2007 | Okabe et al. | 399/111 |
| 2010/0080615 | A1 | 4/2010 | Kikuchi | |
| 2010/0135693 | A1 | 6/2010 | Okabe et al. | |
| 2011/0164897 | A1 | 7/2011 | Kikuchi | |

FOREIGN PATENT DOCUMENTS

| | | | |
|---|---|---|---|
| JP | 2010008511 A | * | 1/2010 |
| JP | 2010-102285 | | 5/2010 |
| JP | 2010-128336 | | 6/2010 |

* cited by examiner

*Primary Examiner* — Robert Beatty

(74) *Attorney, Agent, or Firm* — Banner & Witcoff, Ltd.

(57) ABSTRACT

In an image forming apparatus, photosensitive bodies are mounted in a first frame. Developing units are detachably mounted in the first frame. A second frame is movable relative to the first frame. Each developing unit is movable relative to the first frame between a separate position, at which a developing roller is separate from a photosensitive body, and a contact position, at which the developing roller is in contact with the photosensitive body. The second frame moves relative to the first frame, thereby moving the developing units relative to the first frame between the separate positions and the contact positions. The second frame positions each developing unit relative to the first frame in a direction to move the developing roller toward the corresponding photosensitive body when the developing unit is in the contact position.

11 Claims, 15 Drawing Sheets

IMAGE FORMING APPARATUS AND PROCESS UNIT THAT FORM IMAGES BY USING PHOTOSENSITIVE BODIES AND DEVELOPING UNITS

CROSS-REFERENCE TO RELATED APPLICATION

This application claims priority from Japanese Patent Application No. 2011-120498 filed May 30, 2011. The entire content of this priority application is incorporated herein by reference.

TECHNICAL FIELD

The present invention relates to an image forming apparatus that uses an electrophotographic method, and a process unit for being mounted in the image forming apparatus.

BACKGROUND

There is known a tandem-type color laser printer of an electrophotographic type. This color laser printer is provided with a plurality of photosensitive bodies and a plurality of developing units in one to one correspondence with the photosensitive bodies. The photosensitive bodies are in correspondence with toners of four colors of yellow, magenta, cyan, and black. The photosensitive bodies are juxtaposed with one another and are arranged in a predetermined direction. The developing units are for supplying toner of corresponding colors to the photosensitive bodies.

One example of the color laser printer of the above-described type includes: a drawer unit that retains a plurality of photosensitive drums in correspondence with toner of respective colors; a plurality of developing cartridges each retaining a developing roller; and pressing cams and separating cams that are provided in the drawer unit for bringing the developing rollers and the photosensitive drums into and out of contact with each other.

In such a color laser printer, the pressing cams press the developing cartridges to bring the developing rollers into contact with the photosensitive drums. When the separating cams are actuated, the separating cams release the contact between the developing rollers and the photosensitive drums and separate the developing rollers and the photosensitive drums from each other.

SUMMARY

However, in the above-described conventional color laser printer, the pressing cam and separating cam need to be provided for each developing cartridge.

Therefore, the number of parts constituting the drawer unit increases, increasing the production costs as a result.

An object of the present invention is therefore to provide an improved process unit, in which the number of parts constituting the process unit decreases, but which is capable of bringing the developing rollers and the photosensitive bodies into and out of contact with each other despite having a simple structure.

Another object of the present invention is to provide an improved image forming apparatus provided with the process unit.

In order to attain the above and other objects, the invention provides an image forming apparatus, including: a first frame; and a second frame. A plurality of photosensitive bodies are mounted in the first frame such that the photosensitive bodies are juxtaposed with one another, a plurality of developing units being detachably mounted in the first frame in correspondence with the photosensitive bodies. The second frame is configured so as to be movable relative to the first frame. Each developing unit includes a developing roller that is configured to confront the corresponding photosensitive body. Each developing unit is configured so as to be movable relative to the first frame between a separate position, at which the developing roller is separate from the photosensitive body, and a contact position, at which the developing roller is in contact with the photosensitive body. The second frame is configured to move relative to the first frame, thereby moving the developing units relative to the first frame between the separate positions and the contact positions. The second frame is configured to position each developing unit relative to the first frame in a direction to move the developing roller toward the corresponding photosensitive body when the developing unit is in the contact position.

According to another aspect, the present invention provides a process unit, including: a first frame; and a second frame. A plurality of photosensitive bodies are mounted in the first frame such that the photosensitive bodies are juxtaposed with one another, a plurality of developing units being detachably mounted in the first frame in correspondence with the photosensitive bodies. The second frame is configured so as to be movable relative to the first frame. Each developing unit includes a developing roller that is configured to confront the corresponding photosensitive body. Each developing unit is configured so as to be movable relative to the first frame between a separate position, at which the developing roller is separate from the photosensitive body, and a contact position, at which the developing roller is in contact with the photosensitive body. The second frame is configured to move relative to the first frame, thereby moving the developing units relative to the first frame between the separate positions and the contact positions. The second frame is configured to position each developing unit relative to the first frame in a direction to move the developing roller toward the corresponding photosensitive body when the developing unit is in the contact position.

BRIEF DESCRIPTION OF THE DRAWINGS

The particular features and advantages of the invention as well as other objects will become apparent from the following description taken in connection with the accompanying drawings, in which:

FIGS. 7-9 are left side views of a right side plate in the process frame when the second frame is in one of a plurality of positions, wherein FIG. 7 is for when the second frame is in an all-separate position, FIG. 8 is for when the second frame is in a monochrome image-forming position, and FIG. 9 is for when the second frame is in a multicolor image-forming position;

FIGS. 13-15 are left side views of a right side plate in the process frame shown in FIG. 10 when the second frame is in one of a plurality of positions, wherein FIG. 13 is for when the second frame is in the all-separate position, FIG. 14 is for when the second frame is in the monochrome image-forming position, and FIG. 15 is for when the second frame is in the multicolor image-forming position.

DETAILED DESCRIPTION

Next, embodiments of the present invention will be described while referring to the accompanying drawings.

1. Entire Structure of Color Printer

Figure 1:
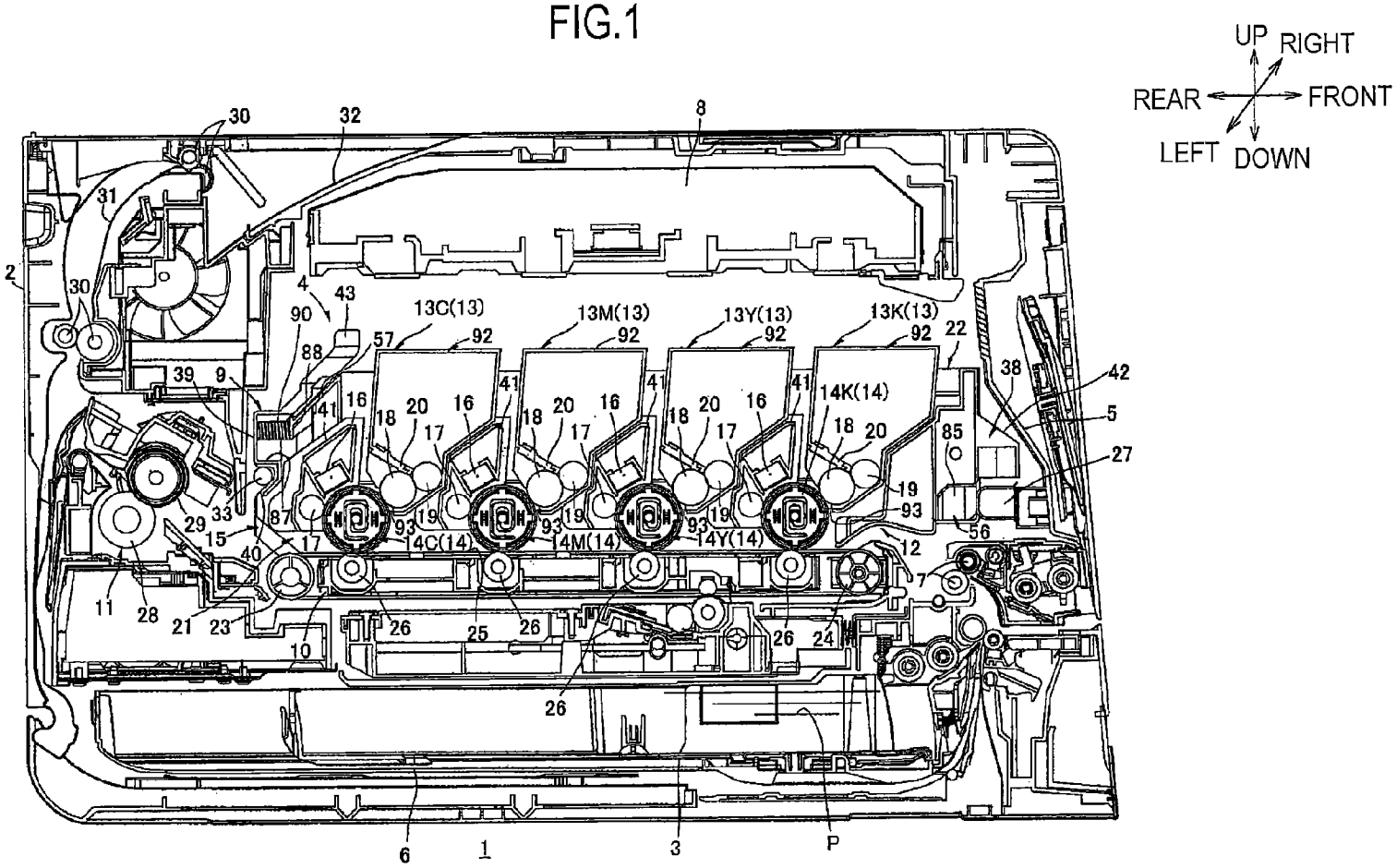
FIG. 1 is a cross-sectional side view of a color laser printer according to a first embodiment of the present invention.

As shown in FIG. 1, a color laser printer 1 according to an embodiment of the present invention is a direct tandem color printer of a horizontal type.

The terms "upward", "downward", "upper", "lower", "above", "below", "beneath", "right", "left", "front", "rear" and the like will be used throughout the description assuming that the color laser printer 1 is disposed in an orientation in which it is intended to be used. In use, the color laser printer 1 is disposed as shown in FIG. 1.

The color laser printer 1 includes a main casing 2, a feeding unit 3 for feeding papers P, and an image-forming unit 4 for forming images on the papers P.

(1) Main Casing

The main casing 2 is a box having a rectangular shape in a side view for accommodating the feeding unit 3 and the image-forming unit 4. A front cover 5 is provided on one side surface of the main casing 2 for allowing a process unit 9 (to be described later) to be mounted in and detached from the main casing 2. The front cover 5 is pivotably openable about a bottom portion thereof.

In the following description, the side of the main casing 2 on which the front cover 5 is provided (the right side in FIG. 1) will be referred to as the "front side," while the opposite side (the left side in FIG. 1) will be referred to as the "rear side." The left and right sides of the main casing 2 will be based on the perspective of a user facing the front side of the color laser printer 1.

The main casing 2 has two pressing portions 27 and a main body reference shaft 33.

The two pressing portions 27 are provided on the rear side surface of the front cover 5. The two pressing portions 27 are arranged in the lower portion of the front cover 5. The two pressing portions 27 are located on the right and left sides of the front cover 5. The pressing portions 27 have substantially a rectangular shape seen in a side view. The pressing portions 27 protrude rearward from the rear side surface of the front cover 5.

The pressing portions 27 are configured to advance and retract in the front-to-rear direction by a known method such as a pulse control method.

The main body reference shaft 33 is a generally rod-shaped member. The main body reference shaft 33 is arranged across the entire lateral length in a rear side portion of the main casing 2.

(2) Feeding Unit

A sheet tray 6 for accommodating papers P is detachably mounted in a bottom section of the main casing 2.

The papers P accommodated in the sheet tray 6 are fed toward between a pair of registration rollers 7 positioned at an upper-front section of the sheet tray 6 one by one, and are sequentially conveyed toward the image-forming unit 4 (more specifically, positions between photosensitive drums 14 (described later) and a conveying belt 25 (described later)) at a predetermined timing.

(3) Image-Forming Unit

The image-forming unit 4 includes a scanner unit 8, the process unit 9, a transfer unit 10, and a fixing unit 11.

(3-1) Scanner Unit

The scanner unit 8 is disposed in an upper section of the main casing 2. The scanner unit 8 irradiates four laser beams toward four photosensitive drums 14 (described later) to expose the four photosensitive drums 14 based on image data.

(3-2) Process Unit (3-2-1) Structure of Process Unit

The process unit 9 is disposed below the scanner unit 8 and above the transfer unit 10, and includes a drum unit 12 and four developing cartridges 13.

The drum unit 12 includes a process frame 15, the four photosensitive drums 14, four Scorotron chargers 16 and four drum cleaning rollers 17. The process frame 15 is a frame of a rectangular shape in a plan view that is elongated in the front-to-rear direction. The process frame 15 is detachably mounted in the main casing 2 and is capable of being pulled out of the main casing 2 in the front-to-rear direction (see FIG. 4). The photosensitive drums 14, Scorotron chargers 16, and drum cleaning rollers 17 are supported by the process frame 15.

Each photosensitive drum 14 has a circular cylindrical shape extending in the left-to-right direction. The four photosensitive drums 14 are juxtaposed with one another and are arranged in the front-to-rear direction as being spaced apart from one another at prescribed intervals. The four photosensitive drums 14 include a black photosensitive drum 14K, a yellow photosensitive drum 14Y, a magenta photosensitive drum 14M, and a cyan photosensitive drum 14C which are arranged in this order from the front to the rear.

Each Scorotron charger 16 is disposed at the upper-rear side of the corresponding photosensitive drum 14 and is spaced away from the corresponding photosensitive drum 14 at a predetermined interval.

Each drum cleaning roller 17 is disposed at a rear side of the corresponding photosensitive drum 14 and contacts the corresponding photosensitive drum 14.

The developing cartridges 13 are disposed in one to one correspondence with the photosensitive drums 14. The developing cartridges 13 include a black developing cartridge 13K, a yellow developing cartridge 13Y, a magenta developing cartridge 13M, and a cyan developing cartridge 13C which are arranged in this order from the front to the rear. Each developing cartridge 13 is detachably supported by the process frame 15 at a position above the corresponding photosensitive drum 14. Each developing cartridge 13 includes a developing roller 18.

The developing roller 18 is disposed at a bottom section of the developing cartridge 13 and is rotatably supported. The rear side of the developing roller 18 is exposed so as to press the corresponding photosensitive drum 14 from the upper front side thereof.

Each developing cartridge 13 includes a supply roller 19 for supplying toner to the developing roller 18; and a layer thickness regulation blade 20 for regulating the thickness of toner supplied onto the developing roller 18. Each developing cartridge 13 accommodates toner of a corresponding color in an upper space above the supply roller 19 and layer thickness regulation blade 20.

(3-2-2) Developing Operation in Process Unit

Toner accommodated in the developing cartridge 13 is supplied to the supply roller 19, then supplied to the developing roller 18, and is positively triboelectrically charged between the supply roller 19 and developing roller 18.

As the developing roller 18 rotates, toner supplied on the developing roller 18 is regulated in its thickness by the layer thickness regulation blade 20, and is borne on the surface of the developing roller 18 as a thin layer of toner in a predetermined thickness.

A surface of each photosensitive drum 14 is uniformly charged by the corresponding Scorotron charger 16 as the photosensitive drum 14 rotates. Then, the surface of the photosensitive drum 14 is exposed by a high speed scanning of the scanner unit 8. Thus, an electrostatic latent image corresponding to an image to be formed on the paper P is formed on the surface of the photosensitive drum 14.

As the photosensitive drum 14 further rotates, the positively-charged tonner carried on the developing roller 18 is supplied onto the electrostatic latent image formed on the photosensitive drum 14 if a second frame 22 (to be described later) is in a monochrome image-forming position or a multicolor image-forming position. Thus, the electrostatic latent image formed on the surface of the photosensitive drum 14 is developed into a visible toner image through a reverse development. Thus, a toner image is formed and borne on the photosensitive drum 14.

(3-3) Transfer Unit

The transfer unit 10 extends in the front-to-rear direction and is disposed above the feeding unit 3 and below the process unit 9 in the main casing 2. The transfer unit 10 includes a drive roller 23, a follower roller 24, the conveying belt 25, and four transfer rollers 26.

The drive roller 23 and the follower roller 24 are in confrontation with each other in the front-to-rear direction and spaced at a predetermined interval.

The conveying belt 25 is stretched around the drive roller 23 and the follower roller 24 so that the conveying belt 25 is disposed below the photosensitive drums 14, and the upper portion of the conveying belt 25 contacts the photosensitive drums 14. The conveying belt 25 circulates in accordance with the rotation of the drive roller 23 so that the upper portion of the conveying belt 25 contacting the photosensitive drums 14 moves from front to rear.

The four transfer rollers 26 are disposed such that the upper section of the conveying belt 25 is nipped between each transfer roller 26 and the corresponding photosensitive drum 14.

The paper P supplied from the feeding unit 3 passes thorough transfer points formed between each photosensitive drum 14 and the corresponding transfer roller 26 from front to rear in accordance with the circularly movement of the conveying belt 25. Thus, the toner image formed on the surface of each photosensitive drum 14 is sequentially transferred and superimposed onto the paper P, thereby a color image being formed on the paper P.

Sometimes, toner remains on the surface of the photosensitive drum 14 after the toner image is transferred onto the paper P from the photosensitive drum 14. However, the residual toner is transferred and held on a peripheral surface of the drum cleaning roller 17 due to a cleaning bias applied to the drum cleaning roller 17, when the residual toner is opposed to the cleaning roller 17 in accordance with the rotation of the photosensitive drum 14.

(3-4) Fixing Unit

The fixing unit 11 is provided on an upper-rear side of the conveying belt 25. The fixing unit 11 is provided with a heat roller 28 and a pressure roller 29 that is pressed to contact the heat roller 28. The toner images transferred onto the paper P are fixed to the paper P by heat and pressure in the fixing unit 11 when the paper P passes through a position between the heat roller 28 and the pressure roller 29.

(4) Discharge Paper

The paper P fixed with toner images is conveyed by various discharge rollers 30 through a U-turn path 31, and discharged onto a discharge tray 32 formed above the scanner unit 8.

2. Details of Process Unit (1) Process Frame

Figure 2:
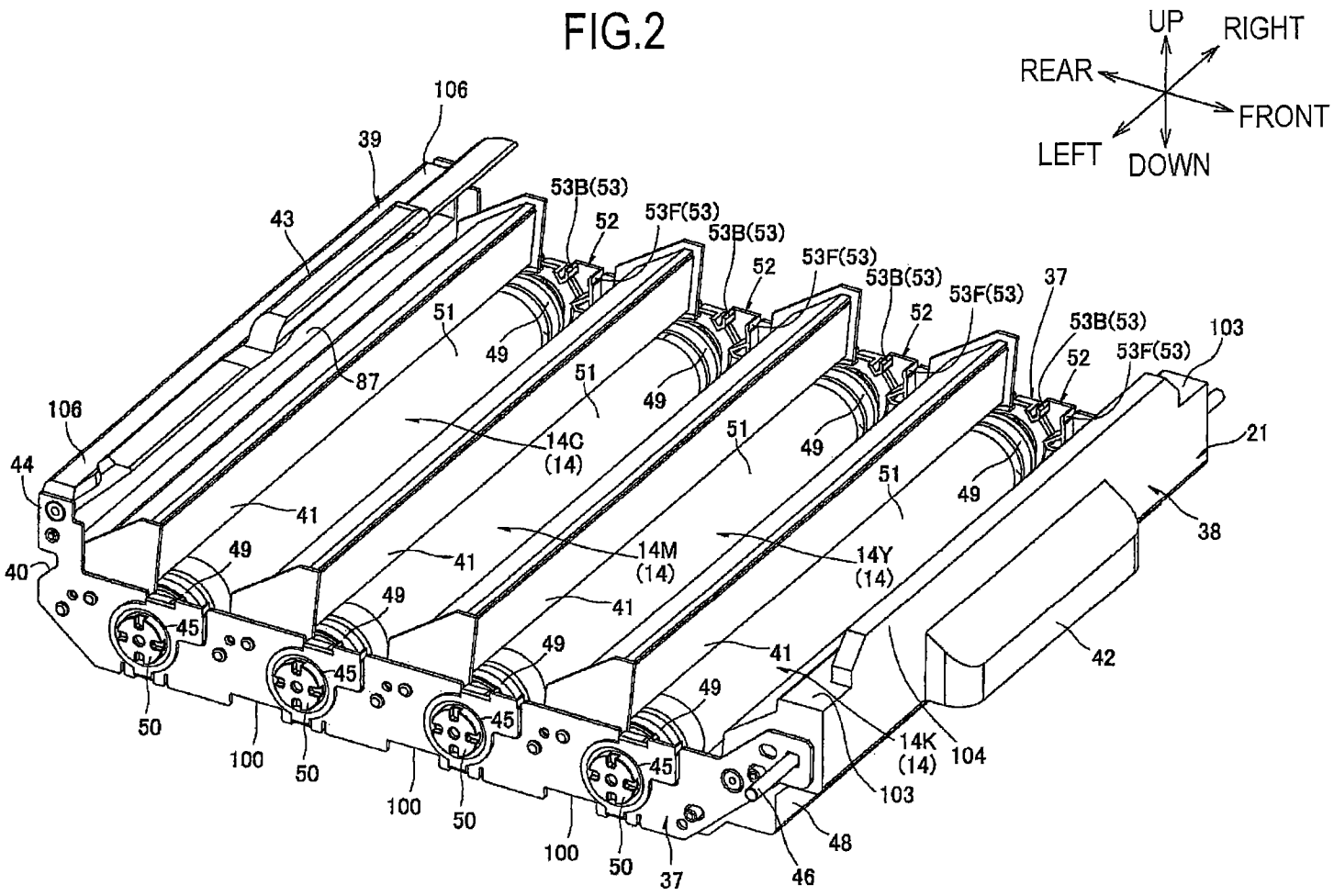
FIG. 2 is a perspective view, seen from an upper left side, of a first frame constituting a process unit shown in FIG. 1.
Figure 3:
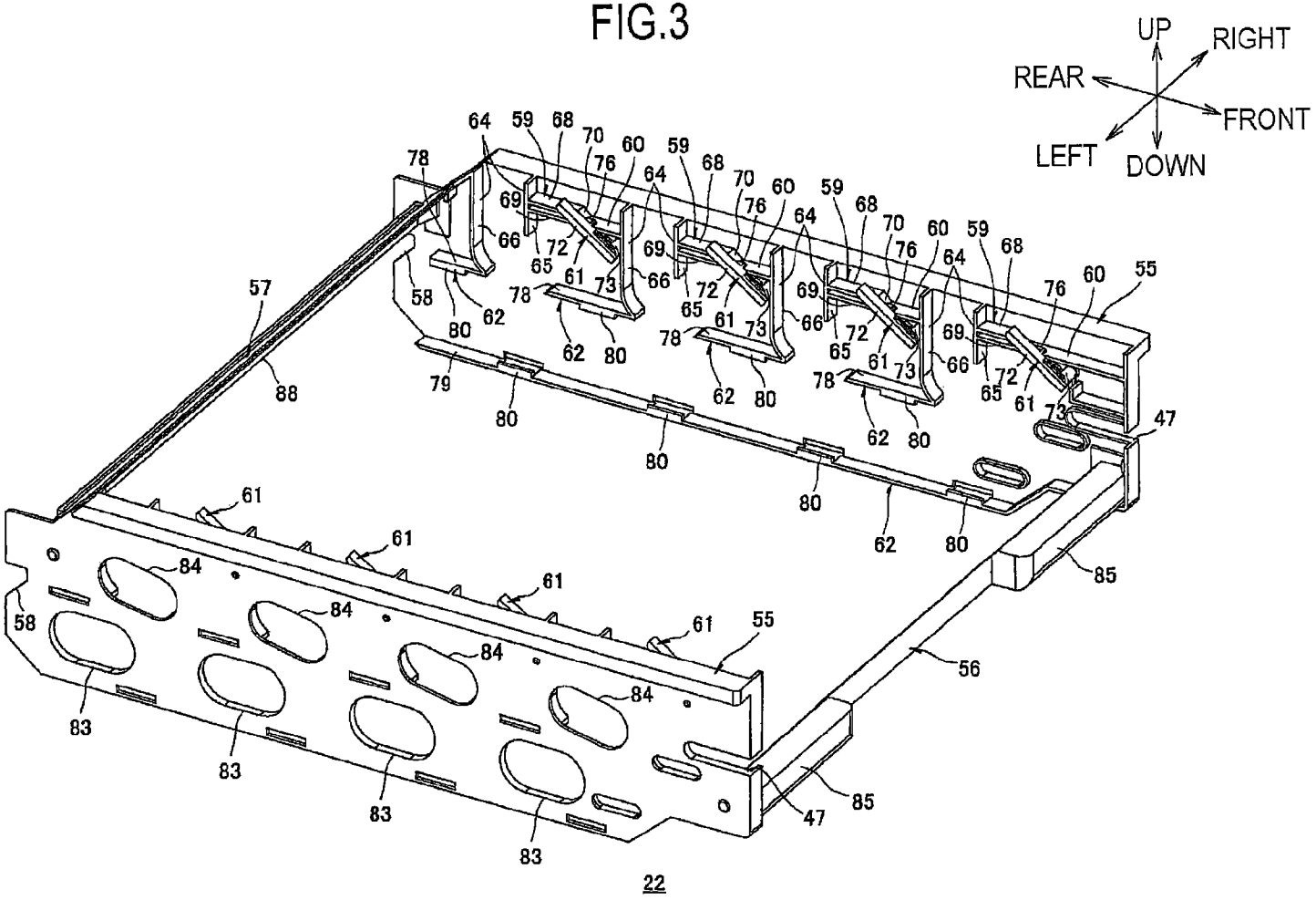
FIG. 3 is a perspective view, seen from an upper left side, of a second frame constituting the process unit.
Figure 4:
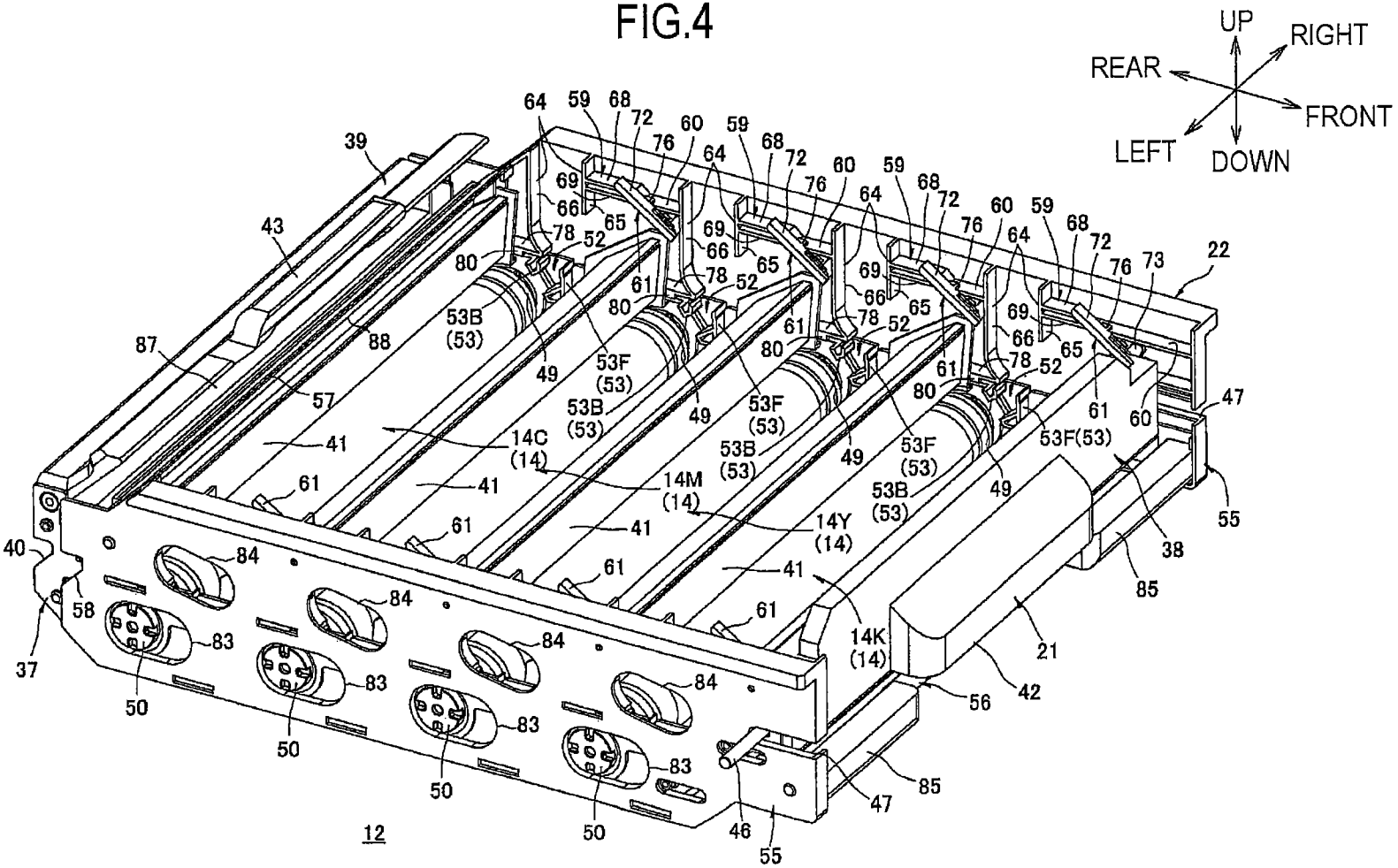
FIG. 4 is a perspective view, seen from an upper left side, of a drum unit shown in FIG. 1.

As illustrated in FIGS. 2 to 4, the process frame 15 includes a first frame 21 and the second frame 22. The second frame 22 is attached to the first frame 21 so as to be movable relative to the first frame 21.

(1-1) First Frame

As illustrated in FIG. 2, the first frame 21 includes a pair of first side plates 37, a front beam 38, and a rear beam 39. Each first side plate 37 is made of a sheet metal.

When seen in a side view, the first side plates 37 have substantially a rectangular shape extending in the front-to-rear direction. Each first side plate 37 is recessed at its front end obliquely upward toward the front, and is recessed at its rear end obliquely upward toward the rear.

Each first side plate 37 is formed with an extension portion 44. The extension portion 44 extends upward from the rear end portion of the first side plate 37.

Each first side plate 37 further has a first notch 40 on its rear edge. The first notch 40 is located at a position where the extension portion 44 is connected to the first side plate 37. When seen in a side view, the first notch 40 is formed substantially in a V-shape with the apex of the V shape facing forward.

The first notch 40 is open to the rear. With the process unit 9 mounted in the main casing 2, the first notch 40 receives the main body reference shaft 33 and makes contact with the main body reference shaft 33 from above and from the lower front (see FIG. 1). Thus, the process unit 9 is positioned relative to the main casing 2 in the front-to-rear direction.

The first side plates 37 each have bearing through-holes 45, guide grooves 52, and lower-edge grooves 100 as illustrated in FIG. 2.

The bearing through-holes 45 have a generally circular shape when seen in a side view. Four bearing through-holes 45 47 are arranged at regular intervals in the front-to-rear direction.

The inner diameter of the bearing through-holes 45 is slightly larger than the outer diameter of bearing fitting parts 50 (to be described later).

Four guide grooves 52 are formed on the inner side surface of each first side plate 37 in the lateral direction. The guide grooves 52 are arranged at regular intervals in the front-to-rear direction (see FIGS. 7 to 9).

Each guide groove 52 extends from the upper edge of the first side plate 37 obliquely rearward and downward toward the corresponding bearing through-hole 45.

Each guide groove 52 is defined between a pair of guide ribs 53 that protrude inward from the inner surface of the first side plate 37 in the lateral direction and that are arranged as being spaced apart from each other in the front-to-rear direction. The guide ribs 53 extend downward from the upper edge of the first side plate 37 and are then bent rearward. The lower edges of the guide ribs 53 are opposed to the photosensitive drum 14 with a small amount of gap being formed between the guide ribs 53 and the photosensitive drum 14.

There are arranged four pairs of guide ribs 53 on each first side plate 37 to define the four guide grooves 52, in total. In each pair of guide ribs 53, a guide rib that is located on the front side and a guide rib that is located on the rear side will be referred to as a "front rib 53F" and a "rear rib 53B", respectively, hereinafter.

There are formed three lower-edge grooves 100 on the lower edge of each first side plate 37. The lower-edge grooves 100 are arranged at regular intervals in the front-to-rear direction. The lower-edge grooves 100 are located respectively on the lower-rear sides of the bearing through-holes 45 other than the rearmost bearing through-hole 45. Each lower-edge groove 100 is formed by cutting the lower edge of the first side plate 37 upward. The lower-edge groove 100 is formed in substantially a rectangular shape when seen in a side view.

The first side plates 37 are laterally opposed to each other at a distance so that the centers of their respective bearing through-holes 45 coincide with each other when seen in a lateral projection.

The front beam 38 spans between the front ends of the first side plates 37.

A housing space 48 is defined on the lower-front side of the front beam 38. The housing space 48 is defined as a recess or space in substantially a rectangular shape when seen in a side view. In other words, the housing space 48 is formed by cutting the lower front part of the front beam 38 over the entire lateral length thereof.

A support shaft 46 penetrates the front beam 38 and the first side plates 37, and protrudes outward in the lateral direction (left-to-right direction) from the first side plates 37.

A front grip part 42 is integrally formed on a lateral center part of the front surface of the front beam 38. The front grip part 42 is formed in substantially a rectangular shape when seen in a side view. The front grip part 42 has a general U shape in cross section with the opening of the U shape facing downward.

The front beam 38 is formed with a protruding wall 104 at its front side. The protruding wall 104 protrudes upward from the upper surface of the front beam 38. The protruding wall 104 has substantially a rectangular shape extending in the lateral direction when seen in a front view. The protruding wall 104 extends over the middle section of the front beam 38 in the lateral direction.

The rear beam 39 spans between the rear ends of the first side plates 37. More specifically, the rear beam 39 spans between the extension portions 44.

Figure 7:
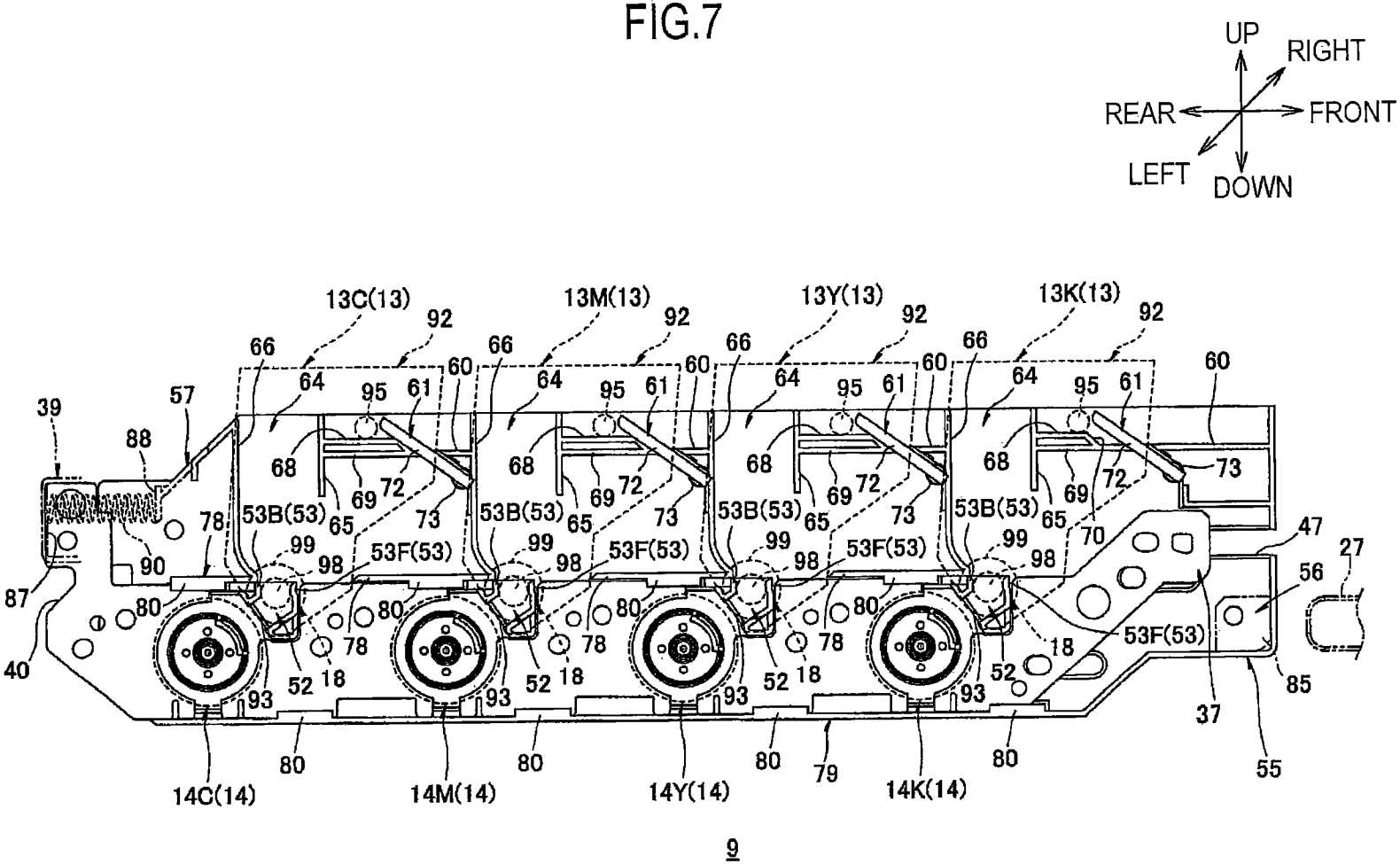
Figure 8:
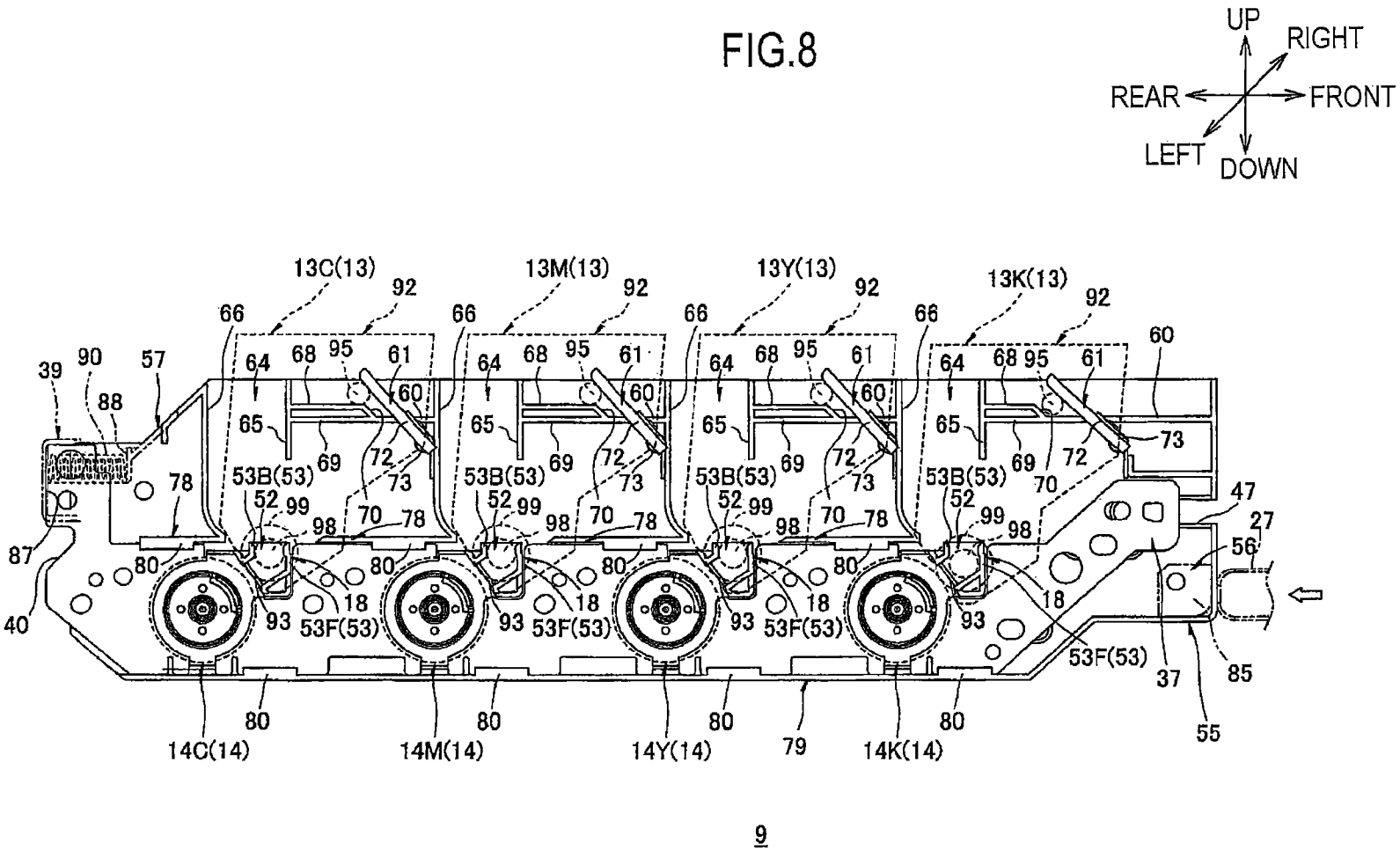
Figure 9:
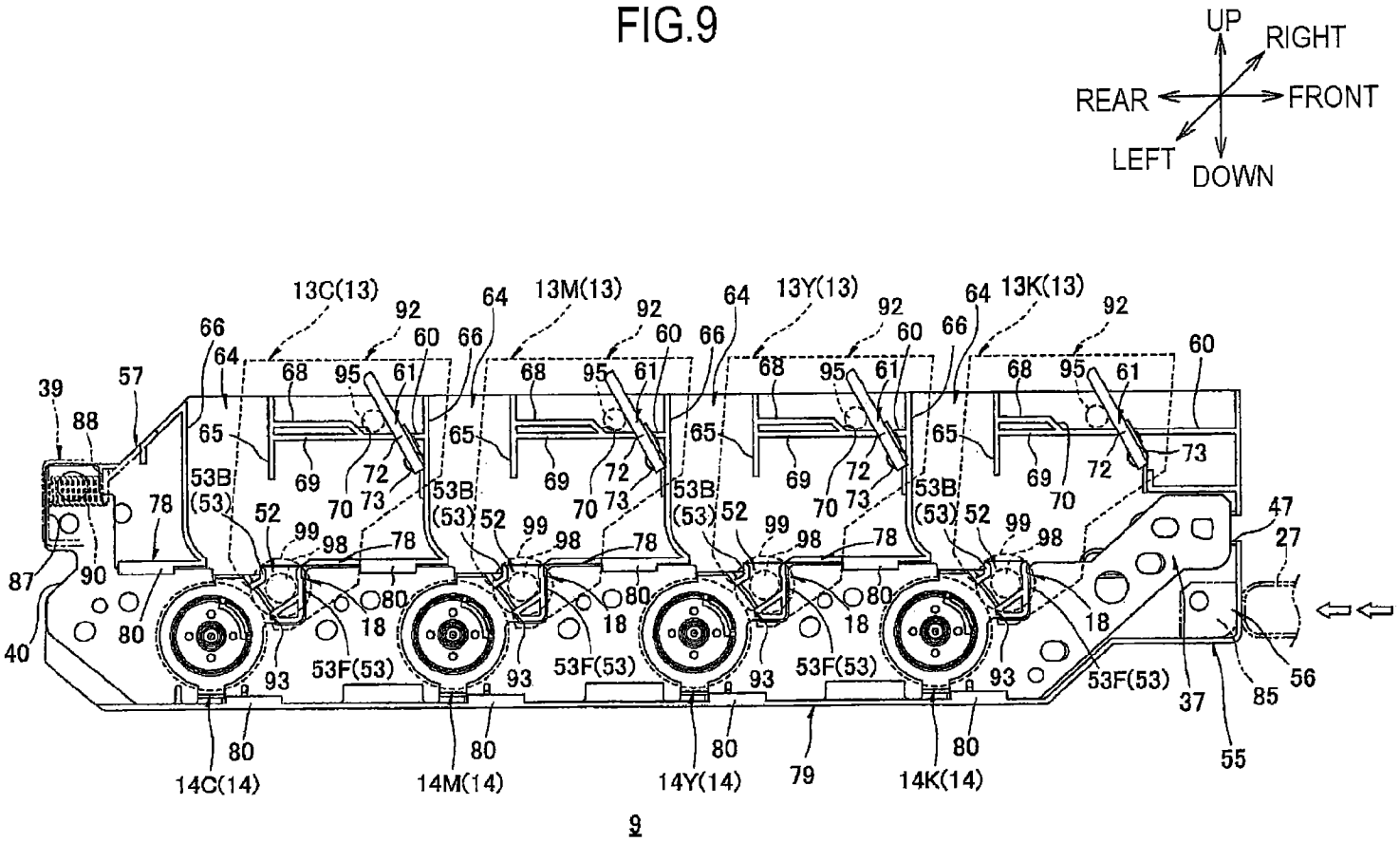

The rear beam 39 has a box-shape having a general U shape in cross section with the opening of the U shape facing frontward (see FIGS. 7 to 9). The inner space of the rear beam 39 is defined as a spring housing part 87.

The rear beam 39 has a rear grip part 43. The rear grip part 43 is integrally formed on the lateral center part of the upper front edge of the rear beam 39. The rear grip part 43 has a general U shape when seen in a rear view with the free ends of the U shape being connected to the rear beam 39. The rear grip part 43 protrudes obliquely upward and forward from the rear beam 39.

The four photosensitive drums 14 and four drum sub-units 41 are mounted on the first frame 21.

(1-2) Photosensitive Drums

Each photosensitive drum 14 includes a tubular body 51 and a pair of flange members 49.

The tubular body 51 is made of metal. The tubular body 51 has substantially a circular cylindrical shape extending in the lateral direction. The outer peripheral surface of the tubular body 51 is covered with a photosensitive layer.

The flange members 49 are respectively fitted to the lateral ends of the tubular body 51 non-rotatably relative to the tubular body 51.

The flange members 49 each have the bearing fitting part 50. The bearing fitting part 50 has a generally circular columnar shape with an outer diameter smaller than the outer diameter of the tubular body 51. The bearing fitting part 50 is arranged to have a common center axis with the tubular body 51. The bearing fitting part 50 is formed to protrude outward in the axial direction from the flange member 49 in a convex shape when seen in a cross section. The bearing fitting part 50 of the right-side flange member 49 protrudes to the right, and the bearing fitting part 50 of the left-side flange member 49 protrudes to the left.

The bearing fitting parts 50 are supported in the bearing through-holes 45 of the first side plates 37 rotatably relative to the first side plates 37. Thus, the photosensitive drums 14 are supported by the first frame 21 rotatably relative to the first frame 21.

(1-3) Drum Sub-Units

As illustrated in FIG. 2, four drum sub units 41 are arranged between the first side plates 37 and between the front beam 38 and the rear beam 39. The drum sub units 41 are juxtaposed with one another and are arranged at regular intervals in the front-to-rear direction so as to come behind and above the respective photosensitive drums 14.

Each drum sub unit 41 is formed in a generally triangular prismatic shape extending in the lateral direction when seen in a side view. Each drum sub unit 41 includes the Scorotron charger 16 and the drum cleaning roller 17 which are held along the lateral direction.

(1-4) Second Frame

As illustrated in FIG. 3, the second frame 22 includes a pair of second side plates 55, a front bridge 56, and a rear bridge 57, all of which are made of resin.

When seen in a side view, the second side plates 55 have substantially a rectangular shape extending in the front-to-rear direction.

Each second side plate 55 has a front recess 47 on its front edge. The front recess 47 is formed to extend rearward. The front recess 47 has substantially a U shape when seen in a side view with the opening of the U shape facing forward. The front recess 47 is for receiving therein the protruding portion of the support shaft 46 when the process frame 15 is assembled together (see FIG. 4).

Each second side plate 55 has formed with a second notch 58 on its rear edge. When seen in a side view, the second notch 58 is formed substantially in a V-shape with the apex of the V shape facing forward. The second notch 58 has substantially the same shape as the first notch 40 and is opened rearward. The second notch 58 is for receiving therein the main body reference shaft 33 when the second frame 22 is located at the multicolor image-forming position (to be described later) (see FIG. 1).

Each second side plate 55 is provided with: guide parts 64, cartridge support parts 59, pressing members 61, and a first frame engagement part 62. All of the guide parts 64, cartridge support parts 59, pressing members 61, and first frame engagement part 62 are provided on the inner side surface of the second side plate 55 in the lateral direction.

Four guide parts 64 are arranged at regular intervals in the front-to-rear direction. Each guide part 64 is defined by a front rib 65 and a rear rib 66.

The front rib 65 and rear rib 66 are each formed to protrude inward from the inner surface of the second side plate 55 in the lateral direction. The front rib 65 and rear rib 66 each have substantially a flat plate shape extending downward from the upper edge of the second side plate 55. The front rib 65 and rear rib 66 are arranged in parallel with each other and are opposed to each other in the front-to-rear direction with a gap being formed therebetween.

The rear rib 66 is longer in the vertical direction (up-to-down direction) than the front rib 65. The rear rib 66 is curved to the front at its lower portion.

Four cartridge support parts 59 are arranged in the front-to-rear direction. The cartridge support parts 59 and the guide parts 64 are arranged alternately in the front-to-rear direction. Each cartridge support part 59 is for supporting a developing cartridge 13 that is introduced into the process frame 15 by a guide part 64 that is located immediately behind the cartridge support part 59. It is noted that among the four cartridge support parts 59, the frontmost cartridge support part 59 is for supporting the black developing cartridge 13K.

Each cartridge support part 59 includes an upper plate 68, a lower plate 69, and a front plate 70. The front plate 70 is integrally formed with an extension portion 60. Each of the upper plate 68, lower plate 69, front plate 70, and the extension portion 60 is formed to protrude inward from the inner surface of the second side plate 55 in the lateral direction. Each of the upper plate 68, lower plate 69, front plate 70, and the extension portion 60 has substantially a flat plate shape, and has a generally rectangular shape when seen in a plan view.

In each cartridge support portion 59, the upper and lower plates 68 and 69 extend frontward from the vertical midsection of a front rib 65 constituting a guide part 64 that is located immediately behind the cartridge support portion 59. The upper plate 68 and lower plate 69 are opposed to each other in the vertical direction with a gap being formed therebetween. The upper plate 68 and lower plate 69 are arranged in parallel with each other. The front-to-rear length of the upper plate 68 is shorter than that of the lower plate 69. The front plate 70 extends between the front ends of the upper plate 68 and the lower plate 69. The front plate 70 is inclined downward toward the front (see FIGS. 7 to 9) because the front-to-rear length of the upper plate 68 is shorter than that of the lower plate 69. The extension portion 60 extends frontward from the front end of the front plate 70, at which the front plate 70 is connected with the lower plate 69.

In each of the cartridge support portions 59 other than the frontmost cartridge support portion 59 (cartridge support portion 59 for the black developing cartridge 13K), the extension portion 60 is connected, at its front end, to the vertical midsection of a rear rib 66 constituting a guide part 64 that is located immediately in front of the cartridge support part 59.

Thus, each of the cartridge support portions 59, other than the frontmost cartridge support portion 59, is arranged to connect the vertical midsection of a front rib 65 constituting a guide part 64 on the rear side with the vertical midsection of a rear rib 66 constituting a guide part 64 on the front side.

It is noted that the upper plate 68 in the frontmost cartridge support part 59 (cartridge support part 59 for the black developing cartridge 13K) is shorter in its front-to-rear length than the upper plates 68 in the other cartridge support parts 59.

There are four pressing members 61 in one to one correspondence with the four cartridge support parts 64. Each pressing member 61 is for applying an urging force onto a developing cartridge 13 that is supported on the corresponding cartridge support part 59.

Each pressing member 61 includes a pressing rod 72, a rotating shaft 73, and an urging member (not shown). The pressing rod 72 has a protrusion 76.

The rotating shaft 73 has a generally circular columnar shape, and is rotatably supported by the second side plate 55 at a position below the extension portion 60.

The pressing rod 72 has a generally rectangular shape when seen in a side view. The protrusion 76 is formed on the central part of the outer side surface of the pressing rod 72 in the lateral direction. The protrusion 76 protrudes from the pressing rod 72 outward in the lateral direction. The pressing rod 72 is connected at its lower end (front end) to the rotating shaft 73 non-rotatably relative to the rotating shaft 73. In this way, the pressing rod 72 is rotatably supported by the second side plate 55 through the rotating shaft 73.

Although not shown in the drawings, the urging member is provided on the rotating shaft 73 to urge the pressing member 61 in a counterclockwise direction when seen from a left side.

The outer surface of the pressing rod 72 in the lateral direction is opposed to the extension portion 60 with a gap being formed between the pressing rod 72 and the extension portion 60. The protrusion 76 is brought into contact with the upper surface of the extension portion 60. This restricts a further rotation of the pressing rod 72.

Thus, the pressing rod 72 is inclined so as to extend upward toward the rear. That is, the pressing rod 72 extends in a direction intersecting with the front-to-rear direction and the vertical direction.

The first frame engagement part 62 includes upper rails 78 and a lower rail 79. The upper rails 78 and lower rail 79 are each formed to protrude inward from the inner surface of the second side plate 55 in the lateral direction.

There are formed four upper rails 78 that are arranged behind the four guide parts 64, respectively. Each upper rail 78 has substantially a flat plate shape extending rearward from the lower edge of a rear rib 66 constituting a guide part 64 that is located just in front of the upper rail 78.

The upper rails 78 are arranged in the front-to-rear direction such that the rear edge of an upper rail 78 located on the front side is opposed to the front edge of an upper rail 78 located on the rear side with a gap being formed therebetween in the front-to-rear direction.

The lower rail 79 has a generally flat plate shape, and is formed on the lower edge of the second side plate 55. The lower rail 79 extends in the front-to-rear direction over the entire length of the lower edge of the second side plate 55.

The upper rails 78 and lower rail 79 are opposed to each other in the vertical direction with a gap being formed therebetween. The gap is substantially equal to the vertical width (height) of the first side plate 37.

The upper rails 78 and lower rail 79 are integrally formed with protruding portions 80. Four protruding portions 80 are formed on the four upper rails 78, respectively. Four protruding portions 80 are formed on the lower rail 79. The protruding portions 80 are formed on the inner side edges of the upper rails 78 and the lower rail 79 in the lateral direction. The protruding portions 80 protrude downward from the upper rails 78. The protruding portions 80 protrude upwardly from the lower rail 79.

Each protruding portion 80 has a generally flat plate shape. The protruding portion 80 is opposed to the second side plate 55 in the lateral direction with a gap being formed between the protruding portion 80 and the second side plate 55. The gap is substantially equal to the lateral thickness of the first side plate 37.

Among the second side plates 55, the second side plate 55 on the left side has formed with four drum exposing through-holes 83 and four insertion through-holes 84.

The drum exposing through-holes 83 are formed in substantially an ellipsoidal shape elongated in the front-to-rear direction when seen in a side view. The drum exposing through-holes 83 are arranged at regular intervals in the front-to-rear direction.

The insertion through-holes 84 are formed in substantially an ellipsoidal shape whose major axis is inclined downward toward the front when seen in a side view. The insertion through-holes 84 are arranged at regular intervals in the front-to-rear direction. The insertion through-holes 84 are arranged in one to one correspondence with the drum exposing through-holes 83 such that each insertion through-hole 84 is located on the upper-front side of the corresponding drum exposing through-hole 83 with a gap being formed between the drum exposing through-holes 83 and the insertion through-hole 84 in the vertical direction.

The front bridge 56 spans between the lower edges of the second side plates 55. The front bridge 56 has formed with pressed portions 85 on its left and right side end portions.

Each pressed portion 85 has a generally rectangular parallelepiped shape elongated in the lateral direction.

The front-to-rear width (depth) of the pressed portions 85 is substantially equal to the front-to-rear size (depth) of the housing space 48.

The rear bridge 57 spans between the upper-rear edges of the second side plates 55. The rear bridge 57 has a generally flat plate shape extending inclined upward toward the front.

The rear bridge 57 has formed with a spring-pressed portion 88. The spring-pressed portion 88 has a generally flat plate shape extending downward from the lower edge (rear edge) of the rear bridge 57 (see FIGS. 7 to 9). The spring-pressed portion 88 is formed over the entire lateral length of the rear beam 57.

(2) Developing Cartridges

Figure 5:
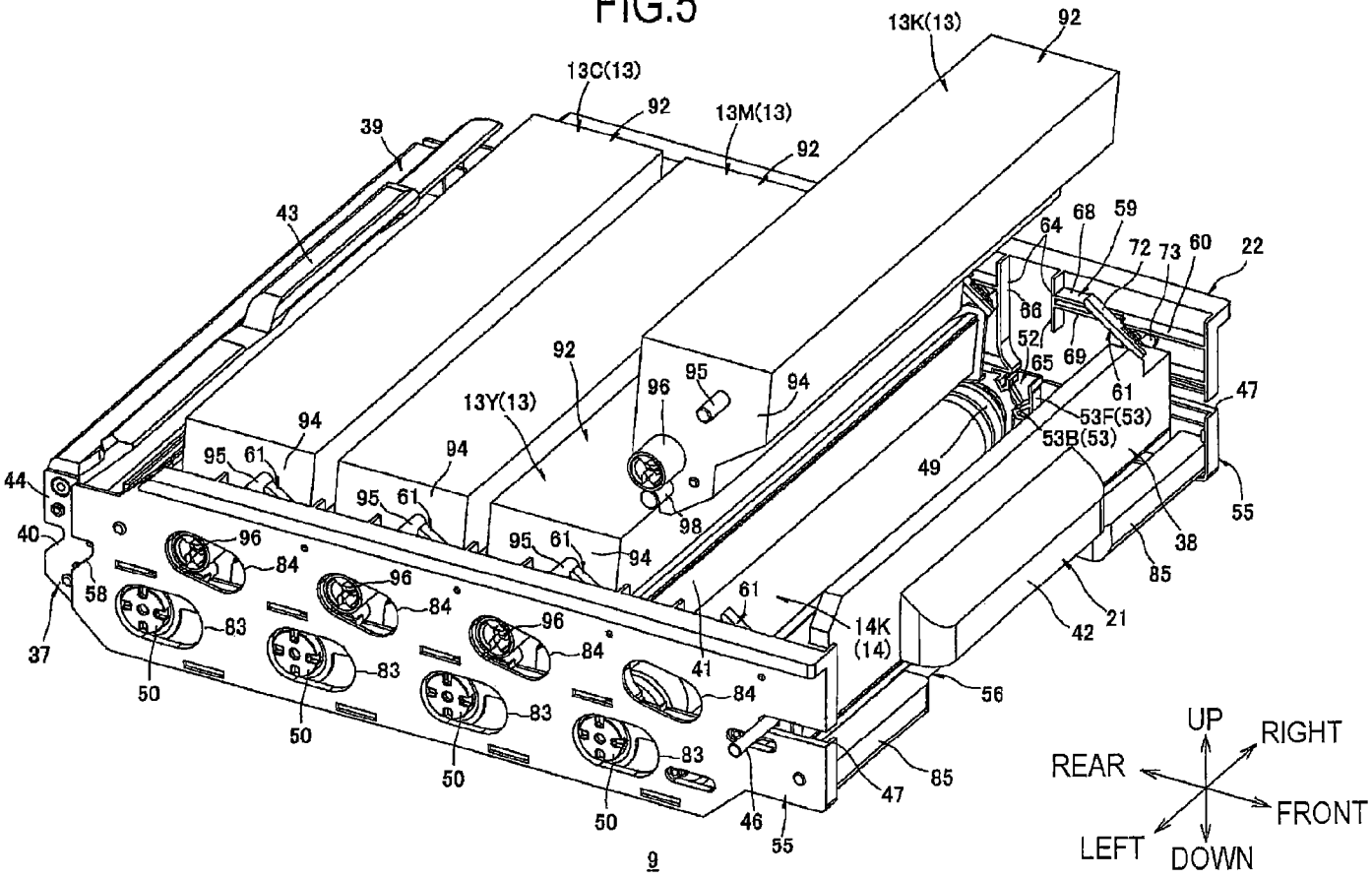
FIG. 5 is a perspective view of the process unit seen from an upper left side.

As illustrated in FIGS. 5 and 7, each developing cartridge 13 includes a developing frame 92 and the developing roller 18.

The developing frame 92 has a generally box shape elongated in the lateral direction as illustrated in FIG. 5.

Both of the left and right ends of the developing frame 92 are closed by side walls 94, respectively.

The side walls 94 are each formed with a boss 95 at its upper-front portion. The boss 95 has a generally circular columnar shape. The boss 95 protrudes from the side wall 94 outward in the lateral direction.

The side wall 94 on the left side is formed with a coupling member 96 at its lower-rear portion. The coupling member 96 has a generally circular columnar shape and protrudes from the side wall 94 outward in the lateral direction. When the process unit 9 is mounted in the main casing 2, drive force of a motor (not illustrated) provided in the main casing 2 can be transmitted to the developing cartridge 13 through the coupling member 96.

As illustrated in FIG. 7, the developing frame 92 is formed with an opening 93 on its lower-rear side edge. The opening 93 is formed over the entire length of the developing frame 92 in the lateral direction.

The developing roller 18 includes: a developing roller shaft 98 made of metal; and a conductive rubber roller 99 provided around the developing roller shaft 98. The developing roller 18 is disposed in the lower-rear portion in the developing frame 92 such that the lower-rear side surface of the rubber roller 99 is exposed through the opening 93. The developing roller shaft 98 extends in the lateral direction and is rotatably supported by the side walls 94. Both ends of the developing roller shaft 98 penetrate the side walls 94 to protrude outward from the side walls 94 as illustrated in FIG. 5.

(3) How to Assemble the Drum Unit

Next will be described how to assemble the drum unit 12. In the first embodiment, in order to assemble the drum unit 12, the second frame 22 is attached to the first frame 21, before the support shaft 46 is inserted through the front beam 38 and the first side plates 37 in the first frame 21.

In order to attach the second frame 22 to the first frame 21 as shown in FIG. 4, the second frame 22 is disposed in front of the first frame 21. At this stage, the first frame 21 already supports the drum sub-units 41 and photosensitive drums 14.

More specifically, the second frame 22 is disposed relative to the first frame 21 such that the front beam 38 of the first frame 21 is opposed in the front-to-rear direction to the space between the rear ends of the second side plates 55 and such that the front edge of each first side plate 37 is opposed in the front-to-rear direction to the space between the upper rail 78 and lower rail 79 in the corresponding second side plate 55.

Two spring members 90 are mounted in the spring housing part 87 in the first frame 21 (see FIGS. 7 to 9). The spring members 90 are disposed respectively on left and right side portions in the spring housing part 87.

Subsequently, the second frame 22 is moved rearward relative to the first frame 21 so that each first side plate 37 is inserted between the upper rails 78 and lower rail 79.

The second frame 22 is moved rearward relative to the first frame 21 so that the first frame 21 is inserted into the second frame 22 until the spring members 90 abut against the spring-pressed portion 88 of the second frame 22 (see FIGS. 7 to 9).

At this time, each first side plate 37 is held by the corresponding second side plate 55 between the upper rails 78 and the lower rail 79 in the vertical direction and between the protruding portions 80 and the second side plate 55 in the lateral direction.

Thus, the second frame 22 is engaged with the first frame 21 so as to be movable in the front-to-rear direction but non-movable in the vertical direction and the lateral direction relative to the first frame 21.

At this state, the left end surfaces of the left side bearing fitting parts 50 in the photosensitive drums 14 are exposed through the drum exposing through-holes 83 of the second frame 22 as shown in FIG. 4.

Next, the support shaft 46 is inserted through the front beam 38 so that left and right ends of the support shaft 46 protrude from the first side plates 37 outwardly in the lateral direction. The protruding ends of the support shaft 47 are inserted through the front recesses 47 in the second side plates 55. In this way, the attachment of the second frame 22 to the first frame 21 is completed. The drum unit 12 is assembled completely.

In this state, the spring-pressed portion 88 is urged by the spring members 90. So, the second frame 22 is urged by the spring members 90 frontward relative to the first frame 21. The lower edges of the rear ribs 66 in the second frame 22 and the upper edges of the rear ribs 53B in the first frame 21 are opposed with each other with a small gap being formed therebetween in the vertical direction (see FIG. 5).

(4) How to Mount Developing Cartridges to Drum Unit

Next will be described how to mount developing cartridges 13 in the drum unit 12.

In order to mount a developing cartridge 13 in the drum unit 12, the developing cartridge 13 is disposed above the second frame 22 of the process frame 15, at a position coinciding with the corresponding photosensitive drum 14 in the front-to-rear direction as illustrated in FIG. 5.

Subsequently, the developing cartridge 13 is moved downwardly and is inserted into the second frame 22. The left and right protruding portions of the developing roller shaft 98 are fitted from above into the corresponding guide parts 64. That is, the left end of the developing roller shaft 98 is fitted from above to the guide part 64 of the left side second side plate 55, and the right end of the developing roller shaft 98 is fitted from above to the guide part 64 of the right side second side plate 55.

Thus, the developing cartridge 13 is inserted into the second frame 22 in the vertical direction while the left and right ends of the developing roller shaft 98 are guided by the guide parts 64.

After the left and right ends of the developing roller shaft 98 reach the lower ends of the rear ribs 66 in the guide parts 64, the developing cartridge 13 enters the first frame 21.

As a result, as illustrated in FIG. 7, the left and right ends of the developing roller shaft 98 are positioned in the upper portions of the guide grooves 52, while being guided by the guide ribs 53.

In such a manner as described above, all of the developing cartridges 13 can be mounted in the drum unit 12.

When all the developing cartridges 13 are mounted in the drum unit 12 as described above, the bosses 95 of all the developing cartridges 13 are brought into contact with the upper surfaces of the upper plates 68 in the cartridge support parts 59. Thus, the developing cartridges 13 are supported by the cartridge support parts 59, and are restricted from moving further downward. The developing rollers 18 are disposed such that the lower-rear side surfaces of the developing rollers 18 are opposed to the photosensitive drums 14 with a gap being formed between the developing rollers 18 and the photosensitive drums 14. So, in this state, the developing rollers 18 in all the developing cartridges 13 are spaced apart from the photosensitive drums 14. The left end surfaces of the coupling members 96 in the developing cartridges 13 are exposed through the insertion through-holes 84 of the second frame 22.

3. How to Contact Developing Cartridge to Photosensitive Drum and how to Separate Developing Cartridge from Photosensitive Drum Next will be described how to contact the developing cartridge 13 to the corresponding photosensitive drum 14 and how to separate the developing cartridge 13 from the photosensitive drum 14.

The color laser printer 1 can be switched between a monochrome mode for forming black-and-white images and a color mode for forming color images.

In the monochrome mode, as illustrated in FIG. 8, the black developing cartridge 13K is at a contact position where the developing roller 18 contacts the black photosensitive drum 14K. The remaining developing cartridges 13 (yellow developing cartridge 13Y, magenta developing cartridge 13M, and cyan developing cartridge 13C) are at separate positions where the developing rollers 18 are separate away from the corresponding photosensitive drums 14 (yellow photosensitive drum 14Y, magenta photosensitive drum 14M, and cyan photosensitive drum 14C). Hereinafter, a position at which a developing roller 18 is in contact with the corresponding photosensitive drum 14 is referred to as "contact position". A position at which a developing roller 18 is separate away from the corresponding photosensitive drum 14 is referred to as "separate position". The yellow developing cartridge 13Y, magenta developing cartridge 13M, and cyan developing cartridge 13C are collectively referred to as "three-color developing cartridges 13YMC".

In the color mode, as illustrated in FIG. 9, all developing cartridges 13 are at the contact potions.

In order to bring the developing cartridges 13 into or out of contact with the photosensitive drums 14, the second frame 22 is moved in the front-to-rear direction in a state where the process unit 9 is mounted in the main casing 2.

In order to move the second frame 22 rearward relative to the first frame 21, the pressing portions 27 are controlled to advance rearward and abut against the pressed portions 85 of the second frame 22, to thereby press the second frame 22 to move rearward against the urging force of the spring members 90, as illustrated in FIGS. 8 and 9. As a result, the second frame 22 moves rearward relative to the first frame 21.

In order to move the second frame 22 frontward relative to the first frame 21, the pressing portions 27 are retracted frontward so as to separate away from the pressed portions 85 as illustrated in FIG. 7. As a result, the second frame 22 moves frontward due to the urging force of the spring members 90. So, the second frame 22 moves frontward relative to the first frame 21.

Thus moving the second frame 22 relative to the first frame 21 in the front-to-rear direction can move the developing cartridges 13 between the contact positions and the separate positions.

According to the present embodiment, the second frame 22 moves from an all-separate position through the monochrome image-forming position to finally reach the multicolor image-forming position as the amount of the pressing force (advancing distance) of the pressing portions 27 increases.

The pressing portions 27 are controlled to advance and retract by a known method such as a pulse control method. The pressing portions 27 are originally located at a standby position. At this time, the second frame 22 is at the all-separate position. When the pressing portions 27 advance rearward from the standby position by a travel distance greater than zero (0) to reach a first advancing position, the second frame 22 reaches the monochrome image-forming position. When the pressing portions 27 further advance rearward from the first advancing position by a travel distance greater than zero (0) to reach a second advancing position, the second frame 22 reaches the multicolor image-forming position.

(1) All-Separate Position

When the pressing portions 27 are at the standby position, the pressing portions 27 are separate away from the pressed portions 85 as illustrated in FIG. 7.

The second frame 22 is urged frontward by the spring members 90 and are located at the all-separate position. The all-separate position is the forwardmost position among the all-separate position, the monochrome image-forming position, and the multicolor image-forming position.

At this stage, as described above, the bosses 95 of all the developing cartridges 13 contact with the upper surfaces of the upper plates 68 of the cartridge support parts 59. So, all the developing cartridges 13 are supported by the cartridge support parts 59.

In this state, all the developing rollers 18 are disposed such that their lower-rear side surfaces are opposed to and spaced apart from the corresponding photosensitive drums 14.

In this way, in the all-separate position, all the developing cartridges 13 are at the separate positions. This is because the spring members 90 urge the second frame 22 in a direction to move all the developing cartridges 13 toward the separate positions.

Figure 6:
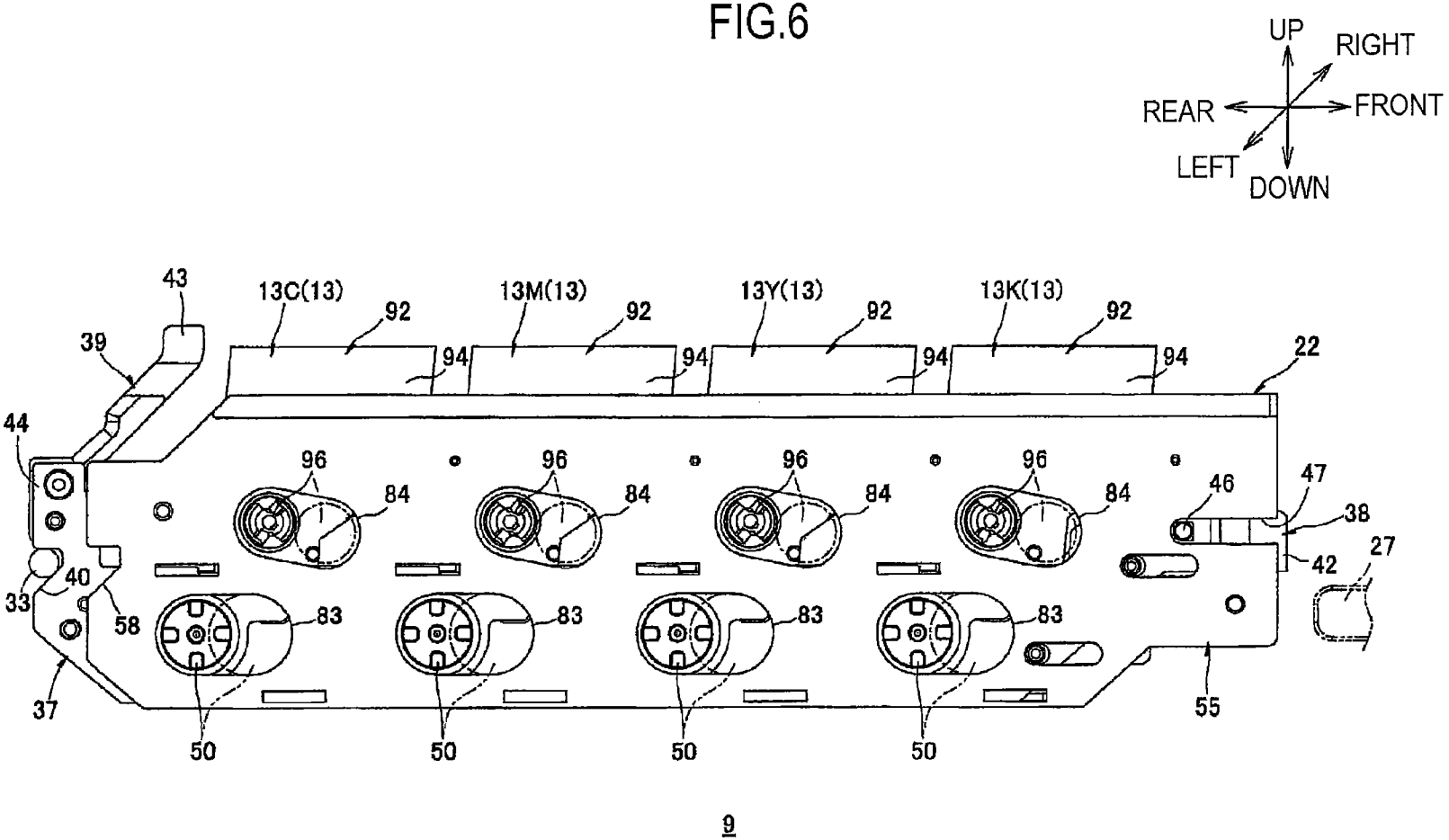
FIG. 6 is a left side view of the process unit.

In the all-separate position, the left end surfaces of all the left side bearing fitting parts 50 are exposed through the drum exposing through-hole 83 as being located on the rear side in the drum exposing through-hole 83, as illustrated in FIG. 6. The left end surfaces of all the coupling members 96 are exposed through the insertion through-holes 84 as being located on the rear side in the insertion through-holes 84.

(2) Monochrome Image-Forming Position

When the pressing portions 27 advances from the standby position to the first advancing position, the pressing portions 27 abut against the pressed portions 85 and presses the pressed portions 85 rearward as illustrated in FIG. 8.

As a result, the pressing portions 27 press the second frame 22 rearward against the urging force of the spring members 90 so as to move the second frame 22 rearward from the all-separate position. Thus, the pressing portions 27 press the second frame 22 in a direction to move the developing cartridges 13 toward the contact positions.

It is noted that as the second frame 22 moves rearward, the cartridge support parts 59 and the pressing members 61 move rearward. The rear ends of the pressing rods 72 abut against the bosses 95 of the developing cartridges 13. In such a case, the boss 95 enters the space below the pressing rod 72, that is, the space between the pressing rod 72 and the upper plate 68 or the front plate 70 because the pressing rod 72 extends in a direction intersecting with both of the front-to-rear direction and the vertical direction. As a result, the boss 95 presses the pressing rod 72 in the upper-front direction against the urging force of the urging member (not illustrated). The pressing rod 72 rotates about the rotating shaft 73 in the clockwise direction when seen from the left side.

When the second frame 22 moves rearward from the all-separate position to the monochrome image-forming position, the boss 95 of only the black developing cartridge 13K drops from the upper plate 68 and moves along the front plate 70 downward toward the front relative to the second frame 22.

As the boss 95 of the black developing cartridge 13K moves downward to the front along the front plate 70, the black developing cartridge 13K moves downward. The left and right ends of the developing roller shaft 98 move downward from the upper portion in the guide grooves 52 to reach the lowermost portion in the guide grooves 52.

As a result, the rubber roller 99 of the developing roller 18 in the black developing cartridge 13K contacts the corresponding photosensitive drum 14 from the upper-front side thereof along the axial direction of the photosensitive drum 14.

Because the front plate 70 is inclined downward toward the front, the black developing cartridge 13K gradually moves downward as the boss 95 moves along the front plate 70. Thus, deformation or breakage of the rubber roller 99 and the photosensitive drum 14 that will possibly occur when the rubber roller 99 contacts the photosensitive drum 14 can be prevented.

In such a manner as described above, the black developing cartridge 13K is located at the contact position.

At this time, the boss 95 of the black developing cartridge 13K is spaced slightly apart from the upper surfaces of the front plate 70 and extension portion 60. That is, the boss 95 of the black developing cartridge 13K is separate away from all of the upper plate 68, front plate 70, and extension portion 60.

Further, the boss 95 of the black developing cartridge 13K is pressed by the pressing rod 72. More specifically, the boss 95 is pressed at its upper-front portion downward to the rear by the urging force of the urging member (not illustrated) of the pressing member 61 in a direction to move the rubber roller 99 toward the photosensitive drum 14.

Thus, at the contact position, the black developing cartridge 13K is positioned relative to the first frame 21 in a direction in which the black developing cartridge 13K moves toward the photosensitive drum 14.

On the other hand, as to the three-color developing cartridges 13YMC, each boss 95 is still in contact with the upper surface of the upper plate 68. Thus, as in the case of the all-separate position, the three-color developing cartridges 13YMC are still supported by the cartridge support parts 59. So, the three-color developing cartridges 13YMC are still located at the separate positions. In this state, the boss 95 of each three-color developing cartridge 13YMC is held between the pressing rod 72 and the upper surface of the upper plate 68.

Although the bosses 95 of the three-color developing cartridges 13YMC are pressed by the pressing rods 72, movement of the three-color developing cartridges 13YMC is restricted because the bosses 95 are in contact with the upper surfaces of the upper plates 68. Thus, the rubber rollers 99 in the three-color developing cartridges 13YMC are restricted from moving toward the photosensitive drums 14.

Thus, at the monochrome image-forming position, only the black developing cartridge 13K is located at the contact position, while the remaining developing cartridges 13 are located at the separate positions.

(3) Multicolor image-forming Position

When the pressing portions 27 advance from the first advancing position to the second advancing position, the second frame 22 moves from the monochrome image-forming position further rearward as illustrated in FIG. 9.

At this time, the pressed portions 85 of the front bridge 56 are housed in the housing space 48 of the front beam 38 (see FIG. 1). That is, the rear side surface of the front bridge 56 abuts against the lower front surface of the front beam 38.

The cartridge support parts 59 and the pressing members 61 move rearward as the second frame 22 moves rearward.

As a result, the bosses 95 of the three-color developing cartridges 13YMC drop from the upper plates 68 and move downward to the front along the inclination of the front plate 70 relative to the second frame 22. As the bosses 95 of the three-color developing cartridges 13YMC move downward to the front along the front plates 70, the three-color developing cartridges 13YMC move downward. The left and right ends of the developing roller shafts 98 move downward from the upper portions in the guide grooves 52 to reach the lowermost portions in the guide grooves 52. As a result, the rubber rollers 99 of the developing rollers 18 in the three-color developing cartridges 13YMC contact the corresponding photosensitive drums 14 from the upper-front sides thereof along the axial direction of the photosensitive drums 14. In this way, the three-color developing cartridges 13YMC are located at the contact positions. At this time, the bosses 95 of the three-color developing cartridges 13YMC are spaced slightly apart from the upper plates 68, front plates 70, and extension portions 60. The bosses 95 of the three-color developing cartridges 13YMC are pressed at their upper-front portions downward to the rear by the urging force of the urging members (not illustrated) of the pressing members 61 in a direction to move the rubber rollers 99 toward the photosensitive drum 14. Thus, at the contact positions, the three-color developing cartridges 13YMC are positioned relative to the first frame 21 in a direction in which the three-color developing cartridges 13YMC move toward the photosensitive drums 14.

In this way, at the multi-color image-forming position, all of the four developing cartridges 13 are located at the contact positions.

In the multicolor image-forming position, as denoted by double-dotted lines in FIG. 6, the left end surfaces of all the left side bearing fitting parts 50 are located on the front side in the drum exposing through-holes 83. The left end surfaces of all the coupling members 96 are located on the front side in the insertion through-holes 84.

In the above description, the second frame 22 moves from the all-separate position to the monochrome image-forming position and then from the monochrome image-forming position to the multicolor image-forming position. However, the second frame 22 can move from any one of the all-separate position, monochrome image-forming position, and multicolor image-forming position to any other one of the all-separate position, monochrome image-forming position, and multicolor image-forming position, depending on the amount of the pressing force (advancing distance) of the pressing portions 27.

4. Operations (1) The process unit 9 includes the drum unit 12 and a plurality of (four) developing cartridges 13.

The drum unit 12 includes the process frame 15. The process frame 15 includes the first frame 21 and second frame 22.

The photosensitive drums 14 for respective colors are mounted in the first frame 21. The second frame 22 is attached to the first frame 21 so as to be movable relative to the first frame 21 in the front-to-rear direction.

Each developing cartridge 13 includes the developing frame 92 and the developing roller 18.

The developing roller 18 is disposed in the lower-rear side portion of the developing frame 92 such that the lower-rear side surface of the rubber roller 99 is exposed through the opening 93.

By moving the second frame 22 relative to the first frame 21 in the front-to-rear direction, each developing cartridge 13 can be moved between the contact position, at which the rubber roller 99 contacts the corresponding photosensitive drum 14, and the separate position, at which the rubber roller 99 is separate away from the corresponding photosensitive drum 14.

Thus, the plurality of developing cartridges 13 can be moved between the separate positions and the contact positions by merely moving the second frame 22. The number of components constituting the process unit 9 can be reduced.

Even with the reduced number of components and the simple configuration, the developing rollers 18 can be brought into and out of contact with the photosensitive drums 14 as needed.

(2) The second frame 22 includes the cartridge support parts 59. Each cartridge support part 59 includes the upper plate 68. The second frame 22 also includes the pressing members 61. Each pressing member 61 includes the pressing rod 72.

When the developing cartridge 13 is in the separate position, the developing cartridge 13 is supported by the upper plate 68. This maintains the rubber roller 99 to be separate from the photosensitive drum 14 with accuracy.

When the developing cartridge 13 is in the contact position, the pressing rod 72 presses the developing cartridge 13 such that the rubber roller 99 moves toward the photosensitive drum 14, thereby achieving stable contact between the rubber roller 99 and the photosensitive drum 14.

Thus, when the developing cartridge 13 is at the separate position, undesirable contact between the rubber roller 99 and the photosensitive drum 14 can be prevented. When the developing cartridge 13 is at the contact position, stable contact between the rubber roller 99 and the photosensitive drum 14 is ensured.

(3) The process unit 9 includes the spring members 90. The spring members 90 are housed in the spring housing part 87 of the first frame 21. The spring members 90 abut against the spring-pressed portions 88 of the second frame 22 to urge the second frame 22 frontward. Thus, the second frame 22 is always urged by the spring members 90 in a direction to position all the developing cartridges 13 at the separate positions. Therefore, all the developing cartridges 13 can be normally positioned at the separate positions. The rubber rollers 99 are normally positioned as being separate from the photosensitive drums 14. This can prevent deformation of the rubber rollers 99 that will possibly occur when the color laser printer 1 or the process unit 9 is transported for shipping or is stored before shipping.

The color laser printer 1 has the pressing portions 27. The pressing portions 27 are provided on the lower-rear side of the front cover 5. The pressing portions 27 press the pressed portions 85 of the second frame 22 when the process unit 9 is mounted in the main casing 2. Thus, the second frame 22 is pressed rearward against the urging force of the spring members 90. That is, the pressing portions 27 press the second frame 22 in a direction to move the developing cartridges 13 from the separate positions to the contact positions. With this configuration, the developing cartridges 13 can be moved from the separate positions to the contact positions as needed to bring the rubber rollers 99 into contact with the photosensitive drums 14.

(4) Depending on the amount of the pressing force of the pressing portions 27, the second frame 22 can be located at any of the following positions: all-separate position, monochrome image-forming position, or multicolor image-forming position.

When the second frame 22 is in the all-separate position, all the developing cartridges 13 are located at the separate positions. When the second frame 22 is in the monochrome image-forming position, only one developing cartridge 13 is located at the contact position. When the second frame 22 is in the multicolor image-forming position, all the developing cartridges 13 are located at the contact positions.

More specifically, when the second frame 22 is in the all-separate position, all the developing rollers 18 are separate from the photosensitive drums 14. When the second frame 22 is in the monochrome image-forming position, only one developing roller 18 contacts a corresponding photosensitive drum 14. When the second frame 22 is in the multicolor image-forming position, all the developing rollers 18 contact the photosensitive drums 14, respectively.

(5) When a developing cartridge 13 is at the separate position, the upper plate 68 of the corresponding cartridge support part 59 contacts the lower portion of the boss 95, thereby restricting the developing cartridge 13 from moving even though the pressing member 61 presses the boss 95. On the other hand, when the developing cartridge 13 is at the contact position, the upper plate 68 is separate away from the boss 95 to allow the developing cartridge 13 to move in accordance with the pressing member 61 pressing the boss 95. Thus, when the developing cartridge 13 is at the separate position, it is ensured that the rubber roller 99 is separate away from the photosensitive drum 14 with accuracy. When the developing cartridge 13 is at the contact position, stable contact between the rubber roller 99 and the photosensitive drum 14 is ensured.

(6) The upper plate 68 for the black developing cartridge 13K is shorter than the upper plates 68 for the three-color developing cartridges 13YMC in their front-to-rear lengths. This simple configuration allows only the black developing cartridge 13K to be located at the contact position when the second frame 22 is at the monochrome image-forming position.

(7) The pressing rod 72 extends in the direction intersecting with both the front-to-rear direction and the vertical direction. More specifically, the pressing rod 72 is inclined to extend upward toward the rear. Thus, the pressing rod 72 intersects with a direction, in which the second frame 22 moves relative to the first frame 21 (front-to-rear direction). So, even when the boss 95 of the developing cartridge 13 contacts the pressing rod 72, the boss 95 can enter the space below the pressing rod 72.

Even with the simple configuration, it is ensured that the second frame 22 is moved relative to the first frame 21 in the front-to-rear direction.

5. Second Embodiment

Next will described a color laser printer 201 according to a second embodiment of the present invention with reference to FIGS. 2 and 10-15. In FIGS. 10 to 15, parts corresponding to those illustrated in FIGS. 1 to 9 are designated by the same reference numerals. Description thereof will be omitted.

The color laser printer 201 of the second embodiment is the same as the color laser printer 1 of the first embodiment except for the points described below.

Figure 10:
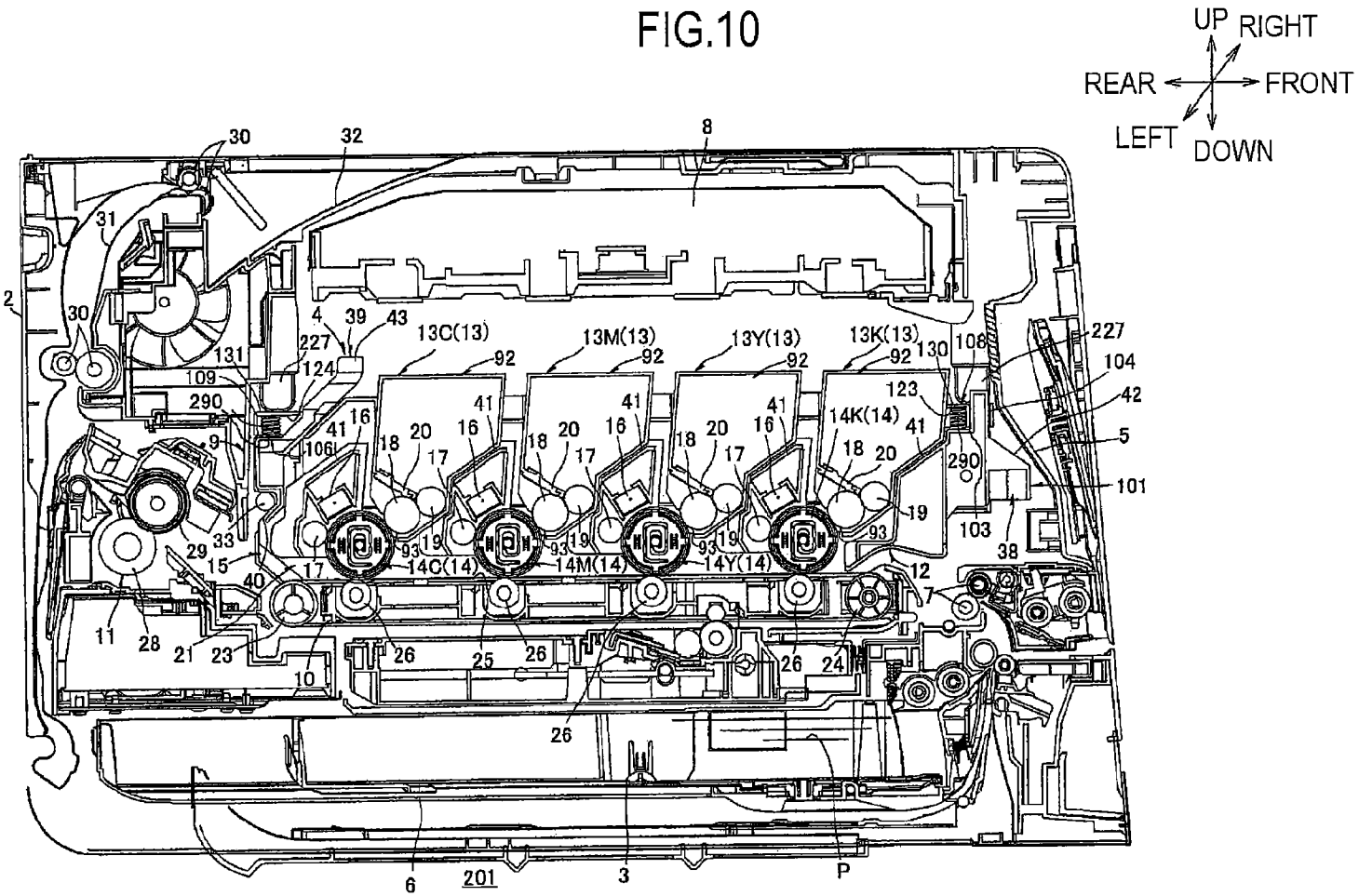
FIG. 10 is a cross-sectional side view of a color laser printer according to a second embodiment.

According to the first embodiment, the main casing 2 is provided with two pressing portions 27 that protrude rearward. Contrarily, according to the second embodiment, the main casing 2 is not provided with such rearward-protruding pressing portions 27, but is provided with four pressing portions 227 that protrude downward as shown in FIG. 10.

According to the first embodiment, the process frame 15 is made up from the first frame 21 shown in FIG. 2 and the second frame 22 shown in FIG. 3. Contrarily, according to the second embodiment, the process frame 15 is made up from the first frame 21 shown in FIG. 2 and a second frame 101 shown in FIG. 11. According to the first embodiment, the second frame 22 is movable in the front-to-rear direction relative to the first frame 21 so as to be located in the all-separate position, the monochrome image-forming position, and the multicolor image-forming position. Contrarily, according to the second embodiment, the second frame 101 is movable in the vertical direction relative to the first frame 21 so as to be located in the all-separate position, the monochrome image-forming position, and the multicolor image-forming position.

According to the first embodiment, the two spring members 90 are mounted in the spring housing part 87 of the rear beam 39. However, according to the second embodiment, the spring members 90 are not mounted in the spring housing part 87. Instead, two spring members 290 are mounted on the front beam 38 and two spring members 290 are mounted on the rear beam 39.

(1) Pressing Portions

More specifically, the four pressing portions 227 are respectively located in right and left side portions in the front and rear sides of the main casing 2. In the state where the process unit 9 is mounted in the main casing 2, two pressing portions 227 are located at positions confronting the left and right side portions of the front beam 38 in the vertical direction, and the other two pressing portions 227 are located at positions confronting the left and right side portions of the rear beam 39 in the vertical direction. The pressing portions 227 are each configured to advance and retract in the vertical direction by a known method such as a pulse control method.

(2) First Frame

According to the second embodiment, left and right side portions of the upper surface of the front beam 38 are used to mount the spring members 290 thereon and therefore will be referred to as "front side spring mounting portions 103". The protruding wall 104 is located between the front side spring mounting portions 103. Similarly, left and right side portions of the upper surface of an upper wall constituting the rear beam 39 are used to mount the spring members 290 thereon and therefore will be referred to as "rear side spring mounting portions 106".

According to the second embodiment, the lower-edge grooves 100 are used to restrict movement of the second frame 101 relative to the first frame 21 and therefore will be referred to as "second frame restricting grooves 100". The front-to-rear length of each second frame restricting groove 100 is set substantially equal to the front-to-rear length of a restricting part 102 (to be described later). The vertical height (depth) of each second frame restricting groove 100 is set substantially equal to a travel distance by which the restricting part 102 (to be described later) moves when the second frame 101 moves from the all-separate position to the multicolor image-forming position.

(3) Second Frame

Figure 11:
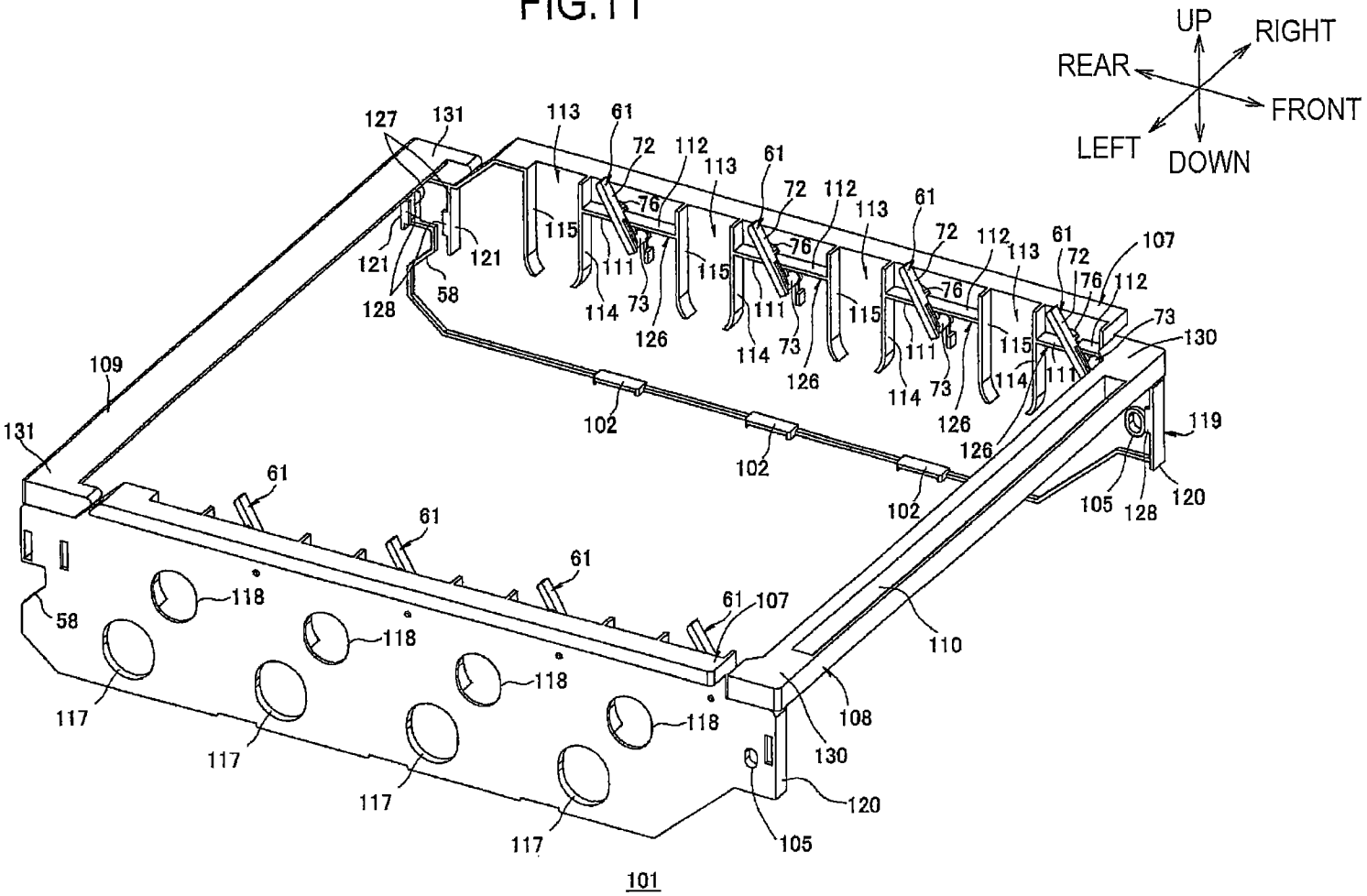
FIG. 11 is a perspective view, seen from an upper left side, of a second frame constituting a process unit shown in FIG. 10.

As illustrated in FIG. 11, the second frame 101 includes a pair of second side plates 107, a front bridge 108, and a rear bridge 109, all of which are made of resin.

When seen in a side view, the second side plates 107 have substantially a rectangular shape extending in the front-to-rear direction.

The second side plates 107 is each formed with a support shaft insertion through-hole 105. The support shaft insertion through-hole 105 is located on the front side of the second side plate 107. When seen in a side view, the support shaft insertion through-hole 105 is formed in substantially an ellipsoidal shape elongated in the vertical direction. The support shaft insertion through-hole 105 is for receiving the protruding portion of the support shaft 46 when the process frame 15 is assembled (see FIG. 12).

Each second side plate 107 is provided with: guide parts 113, cartridge support parts 126, the pressing members 61, a first frame engagement part 119, and restricting parts 102. All of the guide parts 113, cartridge support parts 126, pressing members 61, first frame engagement part 119, and restricting parts 102 are provided on the inner side surface of the second side plate 107 in the lateral direction. The pressing members 61 have the same configuration with the pressing members 61 in the first embodiment.

Four guide parts 113 are arranged at regular intervals in the front-to-rear direction. Each guide part 113 is defined by a front rib 114 and a rear rib 115.

The front rib 114 and rear rib 115 are each formed to protrude inward from the inner surface of the second side plate 107 in the lateral direction. The front rib 114 and rear rib 115 each have substantially a flat plate shape extending downward from the upper edge of the second side plate 107. The front rib 114 and rear rib 115 are arranged in parallel with each other and are opposed to each other in the front-to-rear direction with a gap being formed therebetween.

The lower ends of the front rib 114 and rear rib 115 are curved so as to approach each other in the front-to-rear direction.

Four cartridge support parts 126 are arranged in the front-to-rear direction. The cartridge support parts 126 and the guide parts 113 are arranged alternately in the front-to-rear direction. Each cartridge support part 126 is for supporting a developing cartridge 13 that is introduced into the process frame 15 by a guide part 113 that is located immediately behind the cartridge support part 126. It is noted that among the four cartridge support parts 126, the frontmost cartridge support part 126 is for supporting the black developing cartridge 13K.

Each cartridge support part 126 is formed to protrude inward from the inner surface of the second side plate 107 in the lateral direction. Each of the cartridge support parts 126, other than the frontmost cartridge support part 126 (cartridge support part 126 for the black developing cartridge 13K), has substantially a flat plate shape extending in the front-to-rear direction, and has a generally rectangular shape when seen in a plan view. The frontmost cartridge support part 126 has a plate shape extending in the front-to-rear direction, and has a step 116 in its midsection in the front-to-rear direction. A part of the frontmost cartridge support part 126 that is on the rear side of the step 116 is at a vertical level lower than the remaining part of the front most cartridge support part 126 that is on the front side of the step 116. The frontmost cartridge support part 126 has a generally rectangular shape when seen in a plan view (see FIGS. 13 to 15).

Each cartridge support part 126 extends frontward from the vertical midsection of a front rib 114 constituting a guide part 113 that is located immediately behind the cartridge support part 126. Each of the cartridge support parts 126 other than the frontmost cartridge support part 126 (cartridge support part 126 for the black developing cartridge 13K) is connected, at its front end, to the vertical midsection of a rear rib 115 constituting a guide part 113 that is located immediately in front of the cartridge support part 126. Thus, each of the cartridge support parts 126, other than the frontmost cartridge support part 126, connects the vertical midsection of a front rib 114 constituting a guide part 113 on the rear side with the vertical midsection of a rear rib 115 constituting a guide part 113 on the front side.

For each cartridge support part 126, a support portion 111 is defined as a portion of the cartridge support part 126 that is located on a rear side of the pressing rod 72. An extension portion 112 is defined as a portion of the cartridge support part 126 that is located on a front side of the pressing rod 72. For the frontmost cartridge support part 126, the support portion 111 is defined as a part of the cartridge support part 126 located on the rear side of the step 116, while the extension portion 112 is defined as a remaining part of the cartridge support part 126 that is located on the front side of the step 116. So, in the frontmost cartridge support part 126, the support portion 111 is at a vertical level lower than the extension portion 112.

It is noted that the support portion 111 in the frontmost cartridge support part 126 (cartridge support part 126 for the black developing cartridge 13K) is at a vertical level lower than the support portions 111 in the other cartridge support parts 126.

The pressing members 61 are provided in one to one correspondence with the cartridge support parts 126. In the present embodiment, the rotating shaft 73 constituting each pressing member 61 is located below the extension portion 112 of the corresponding cartridge support part 126. The rotating shaft 73 is rotatably supported by the second side plate 107. The outer surface of the pressing rod 72 in the lateral direction is opposed to the cartridge support part 126 with a gap being formed between the pressing rod 72 and the cartridge support part 126. The protrusion 76 is brought into contact with the upper surface of the cartridge support part 126. This restricts a further rotation of the pressing rod 72.

The first frame engagement part 119 includes a front rail part 120 and a rear rail part 121.

The front rail part 120 has substantially a flat plate shape. The front rail part 120 extends from the front end of the second side plate 107 inward in the lateral direction.

The rear rail part 121 includes a pair of rail ribs 127. The pair of rail ribs 127 are each formed to protrude inward from the inner surface of the second side plate 107 in the lateral direction. The pair of rail ribs 127 are located in the rear side portion of the second side plate 107. Each rail rib 127 has substantially a flat plate shape extending downward from the upper edge of the second side plate 107. The pair of rail ribs 127 are opposed to each other in the front-to-rear direction with a gap being formed therebetween (see FIGS. 13 to 15). The pair of rail ribs 127 extend parallel with each other. The gap between the pair of rail ribs 127 is substantially equal to the front-to-rear width of the extension portions 44 of the first side plates 37.

The front rail part 120 and rear rail part 121 are integrally formed with protruding portions 128. The protruding portions 128 are formed on the inner edges of the front rail part 120 and the rear rail part 121 in the lateral direction. One protruding portion 128 protrudes rearward from the front rail part 120. In the rear rail part 212, one protruding portion 128 protrudes from each rail rib 127 toward the other rail rib 127.

Each protruding portion 128 has substantially a flat plate shape. The protruding portions 128 are opposed to the second side plate 107 in the lateral direction with a gap being formed between the protruding portions 128 and second side plate 107. The gap is substantially equal to the lateral thickness of the first side plates 37.

Three restricting parts 102 are formed on the lower edge of the second side plate 107. The restricting parts 102 are each formed to protrude inward from the inner surface of the second side plate 107 in the lateral direction. The restricting parts 102 are arranged at regular intervals in the front-to-rear direction. Each restricting part 102 has substantially a U shape when seen in a side view with its opening facing downward.

Among the second side plates 107, the second side plate 107 on the left side has formed with four drum exposing through-holes 117 and four insertion through-holes 118.

The drum exposing through-holes 117 are formed in substantially an ellipsoidal shape elongated in the vertical direction when seen in a side view. The drum exposing through-holes 117 are arranged at regular intervals in the front-to-rear direction. The insertion through-holes 118 are formed in substantially an ellipsoidal shape elongated in the vertical direction when seen in a side view. The insertion through-holes 118 are arranged at regular intervals in the front-to-rear direction. The insertion through-holes 118 are arranged in one to one correspondence with the drum exposing through-holes 117 such that each insertion through-hole 118 is located on the upper-front side of the corresponding drum exposing through-hole 117 with a gap being formed between the drum exposing through-holes 117 and the insertion through-hole 118 in the vertical direction.

The front bridge 108 spans between the upper-front edges of the second side plates 107. The front bridge 108 has substantially a rectangular shape when seen in a plan view. The front bridge 108 has a U shaped cross section with its opening facing downward.

An opening 110 is formed through an upper wall constituting the front bridge 108. The opening 110 is formed in substantially a rectangular shape when seen from above.

The front bridge 108 has front side pressed portions 130 and front side spring-pressed portions 123 on the left and right sides (see FIGS. 11 to 15). The front side pressed portions 130 are defined by the left and right side areas of the upper surface of the upper wall constituting the front bridge 108. The front side spring-pressed portions 123 are defined by the left and right side areas of the lower surface of the upper wall constituting the front bridge 108. Thus, the front side pressed portions 130 and the front side spring-pressed portions 123 are defined on the opposite surfaces of the upper wall constituting the front bridge 108.

The rear bridge 109 spans between the upper-rear edges of the second side plates 107. The rear bridge 109 has substantially an L-shape cross-section that is bent downward.

The rear bridge 109 has rear side pressed portions 131 and rear side spring-pressed portions 124 on the left and right sides (see FIGS. 11 to 15). The rear side pressed portions 131 are defined by the left and right side areas of the upper surface of an upper wall constituting the rear bridge 109. The rear side spring-pressed portions 124 are defined by the left and right side areas of the lower surface of the upper wall constituting the rear bridge 109. Thus, the rear side pressed portions 131 and the rear side spring-pressed portions 124 are defined on the opposite surfaces of the upper wall constituting the rear bridge 109.

(4) How to Assemble Drum Unit

Next will be described how to assemble the drum unit 12 in the second embodiment.

In order to assemble the drum unit 12, the second side plates 107 constituting the second frame 101 are attached to the first frame 21. At this stage, the support shaft 48 is not yet inserted through the front beam 38 or the first side plates 37 in the first frame 21. The front and rear bridges 108 and 109 are not yet connected to the second side plates 107 in the second frame 101.

Figure 12:
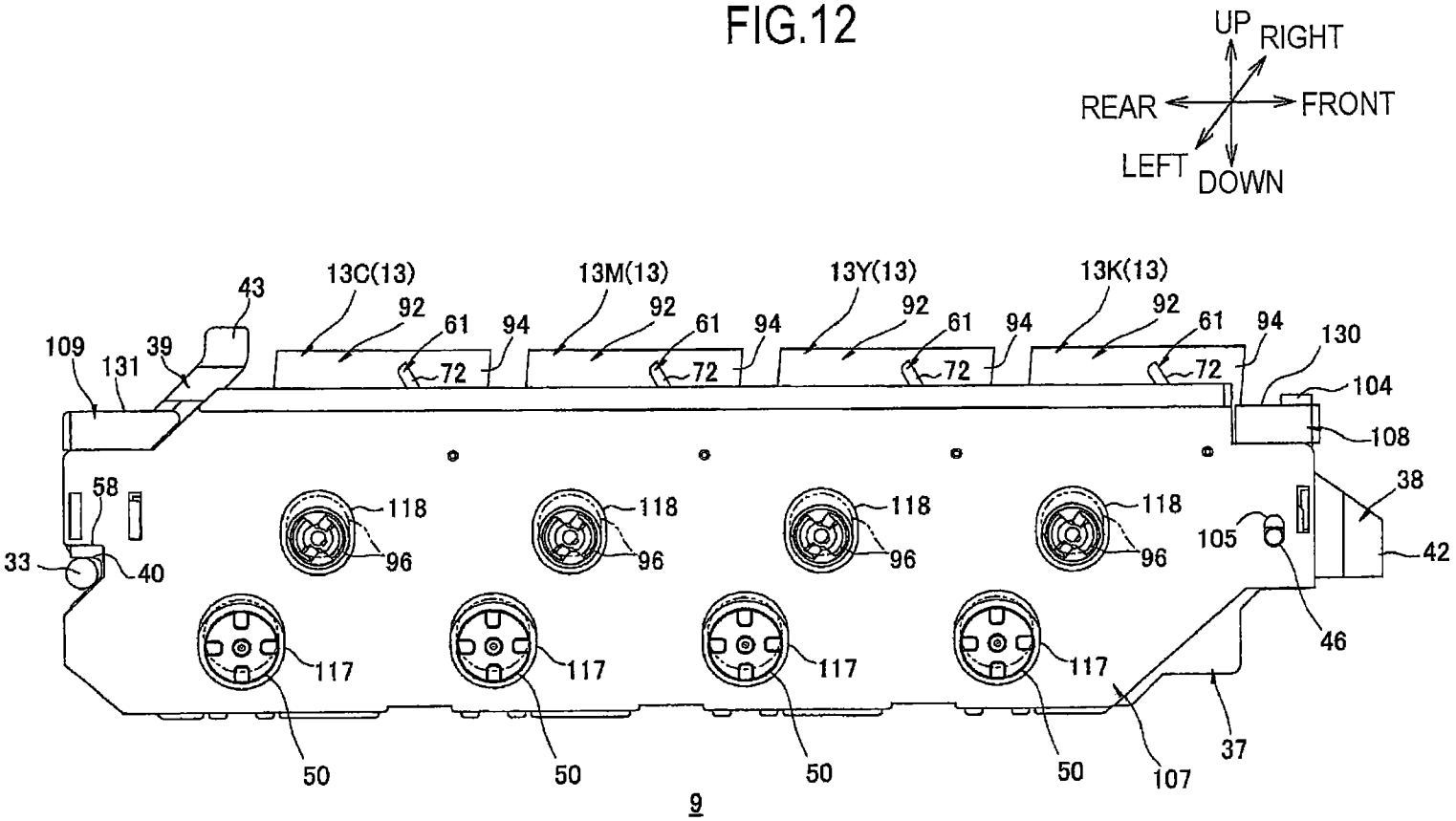
FIG. 12 is a left side view of the process unit shown in FIG. 10.

In order to attach the second side plates 107 to the first frame 21 as shown in FIG. 12, the second side plates 107 are disposed below the first frame 21. At this stage, the first frame 21 already supports the drum sub-units 41 and the photosensitive drums 14.

More specifically, the second side plates 107 are disposed relative to the first frame 21 such that the front edge of each first side plate 37 aligns with the front rail part 120 of the second side plate 107 in the vertical direction and such that the extension portion 44 of the first side plate 37 aligns with the space between the pair of rail ribs 127 in the rear rail part 121 of the second side plate 107 in the vertical direction.

Then, the second side plates 107 are moved upward relative to the first frame 21 so that the first frame 21 is inserted between the second side plates 107. More specifically, the second side plates 107 are moved upward relative to the first frame 21 so that the front edges of the first side plates 37 are each inserted between the protruding portion 128 and the second side plate 107 and the extension portions 44 of the first side plates 37 are each inserted between the pair of rail ribs 127.

As a result, the first side plates 37 are each held between the front rail part 120 and the pair of rail ribs 127 in the front-to-rear direction and between the protruding portions 128 and the second side plate 107 in the lateral direction.

Thus, the second side plates 107 are engaged with the first frame 21 so as to be movable in the vertical direction but non-movable in the front-to-rear direction and the lateral direction relative to the first frame 21.

Figure 13:
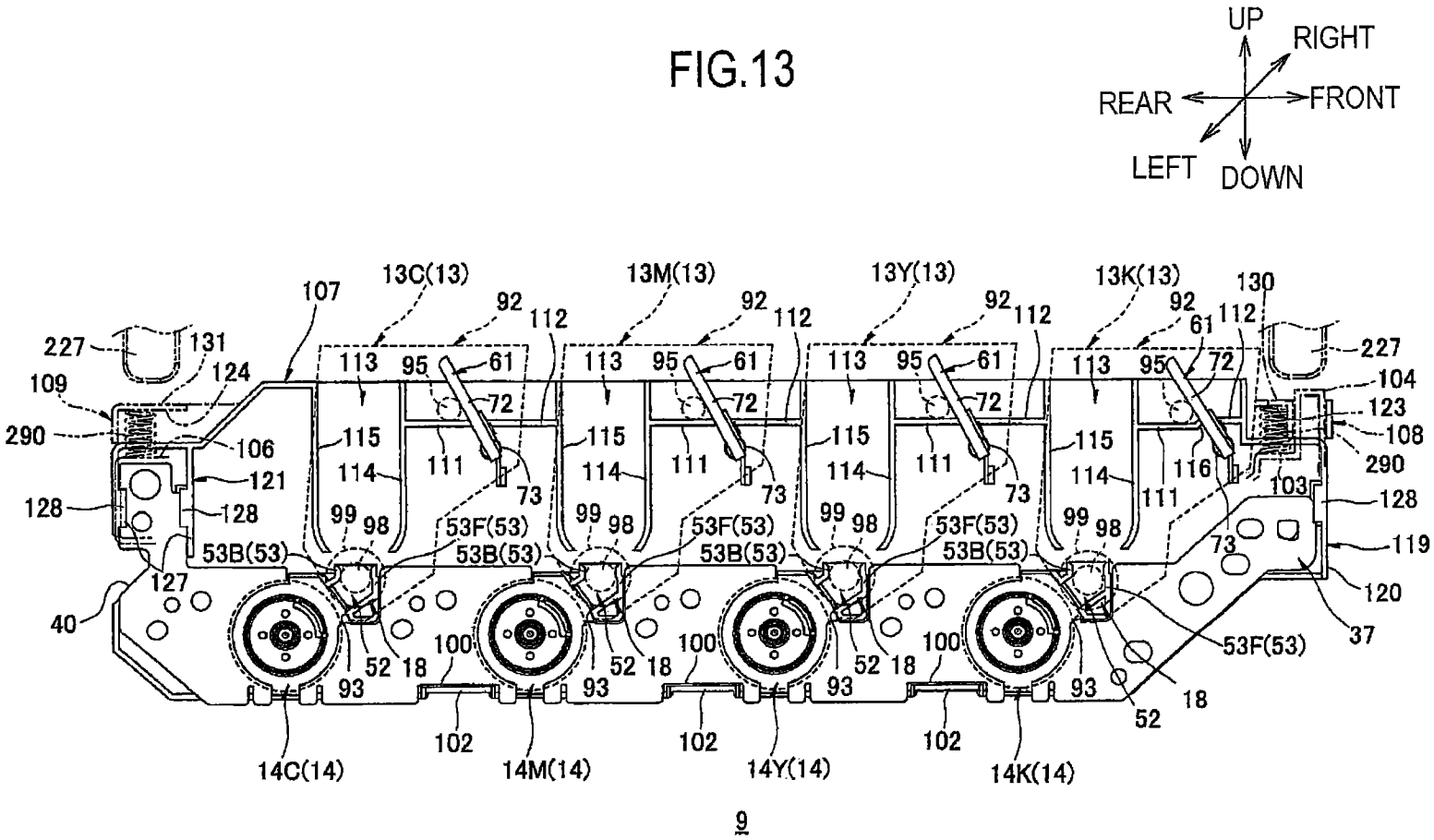
Figure 14:
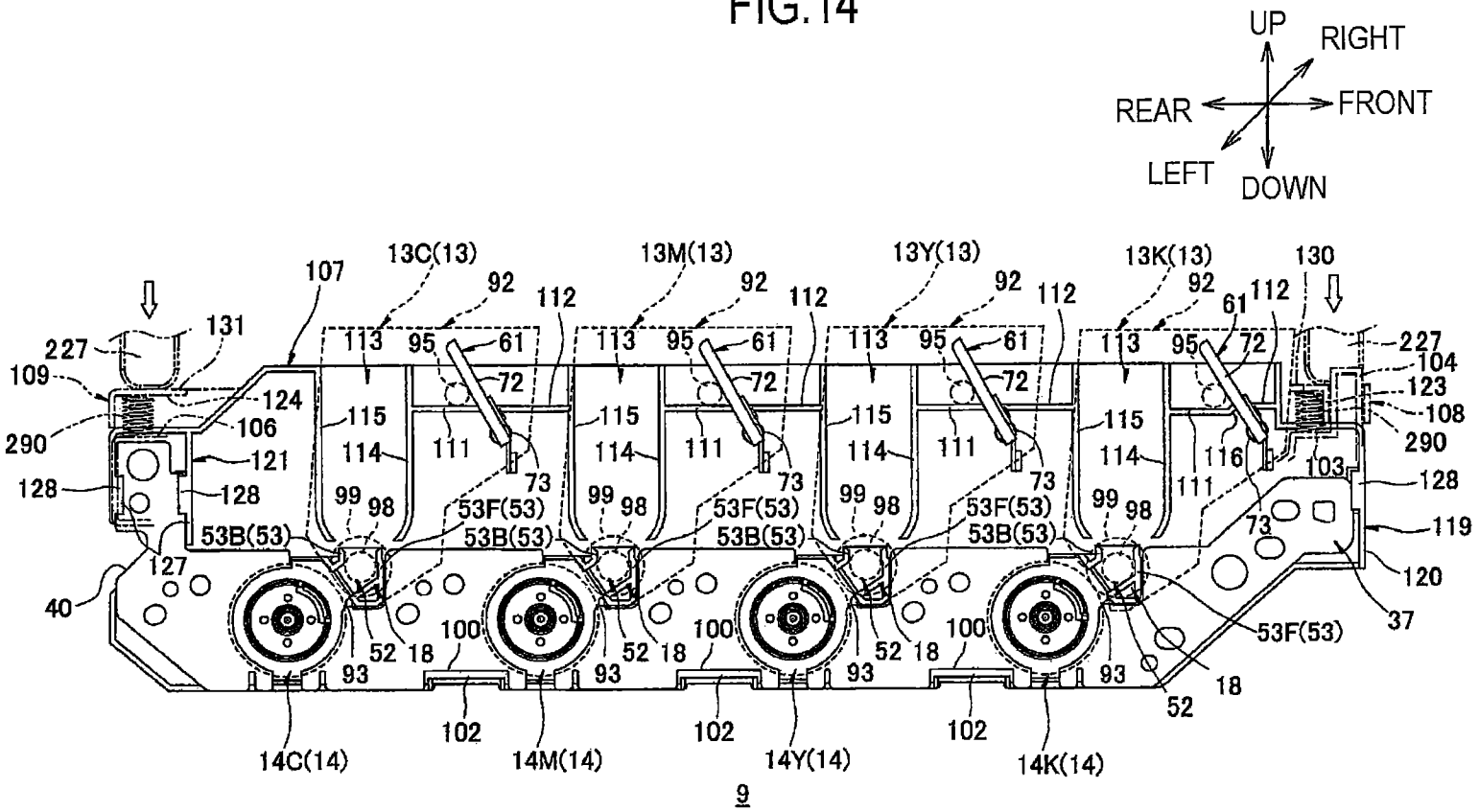
Figure 15:
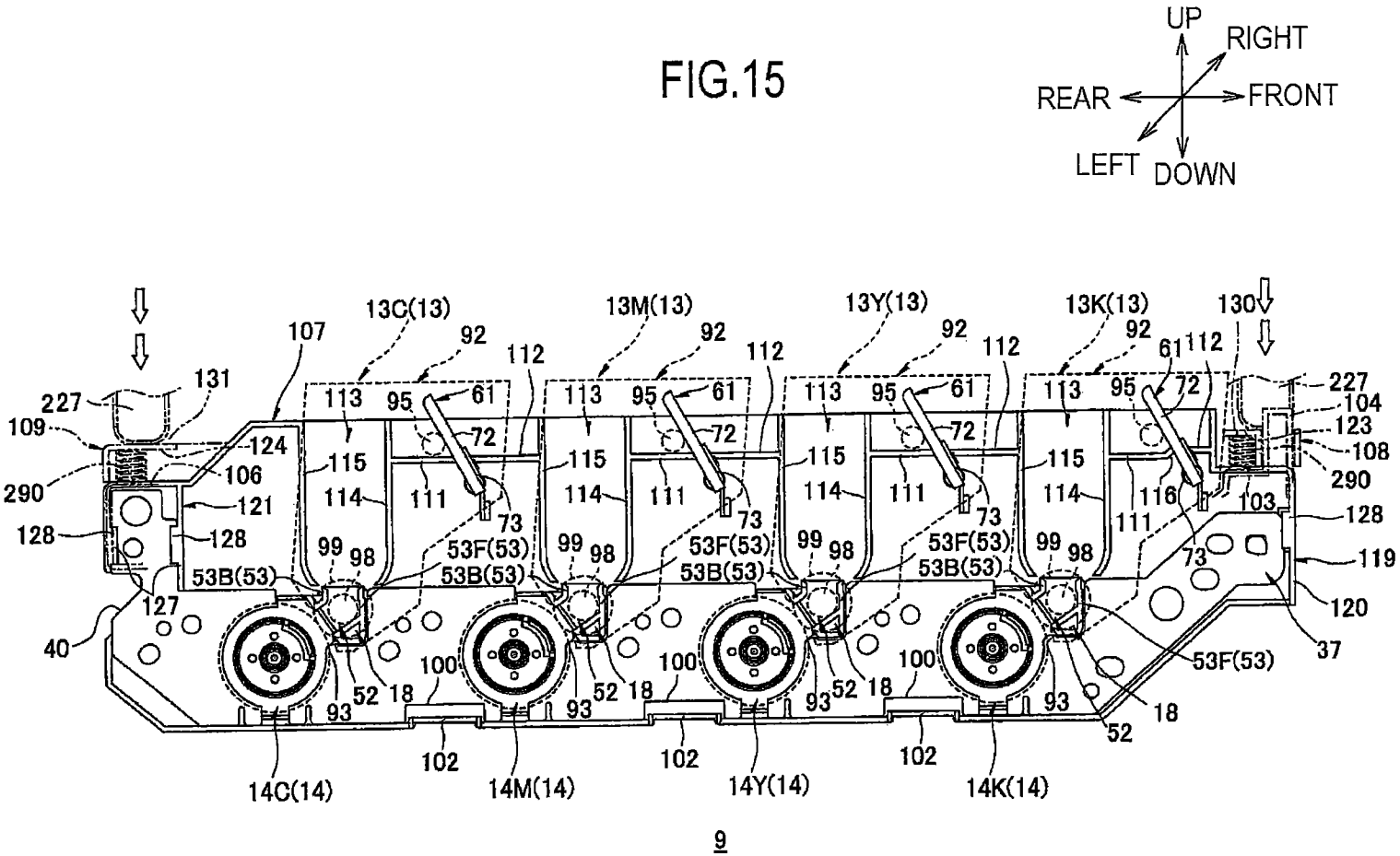

Next, the four spring members 290 are respectively mounted on the front side spring mounting portions 103 of the front beam 38 and the rear side spring mounting portions 106 of the rear beam 39 (see FIGS. 13 to 15).

Subsequently, the front bridge 108 is attached to the second side plates 107 so that the protruding wall 104 of the front beam 38 is inserted through the opening 110 (see FIGS. 12 to 15) and so that two spring members 290 are held between the front beam 38 and the front bridge 108. The rear bridge 109 is attached to the second side plates 107 so that the other two spring members 290 are held between the rear beam 39 and the rear bridge 109. As a result, the second frame 101 is completely assembled.

In this state, the spring members 290 are held between the front side spring mounting portions 103 and the front side spring-pressed portions 123 and between the rear side spring mounting portions 106 and the rear side spring-pressed portions 124 (see FIGS. 13 to 15). The left end surfaces of the left side bearing fitting parts 50 in the photosensitive drums 14 are exposed through the drum exposing through-holes 117 of the second frame 101.

Next, the support shaft 46 is inserted through the front beam 38 so that left and right ends of the support shaft 46 protrude from the first side plates 37 outwardly in the lateral direction. The protruding ends of the support shaft 47 are inserted through the support shaft insertion through-holes 105 in the second side plates 107. In this way, the attachment of the second frame 101 to the first frame 21 is completed. The drum unit 12 is assembled completely.

In this state, the second frame 101 is urged upward at its front side spring-pressed portions 123 and rear side spring-pressed portions 124 by the spring members 290. The restricting parts 102 of the second frame 101 are, however, fitted in the second frame restricting grooves 100 of the first frame 21. So, the second frame 101 is restricted from moving further upward relative to the first frame 21.

(5) How to Mount Developing Cartridges in Drum Unit

The developing cartridges 13 can be mounted in the drum unit 12 in a manner that is the same as that in the first embodiment except for the following point:

That is, when mounting a developing cartridge 13 in the drum unit 12, a user holds the pressing rods 72 of the corresponding pressing members 61 and rotates the pressing rods 72 in a clockwise direction when seen from a left side against the urging force of the urging members (not illustrated) of the pressing members 61. This prevents the pressing rods 72 from abutting against the bosses 95 of the developing cartridge 13 when the user moves the developing cartridge 13 downwardly. The bosses 95 can therefore travel on the rear side of the pressing rods 72. The user takes his/her hands off the pressing rods 72 after the bosses 95 have passed by the rear edges of the pressing rods 72. When the user takes his/her hands off the pressing rods 72, the pressing rods 72 rotate in a counterclockwise direction when seen from a left side due to the urging force of the urging members (not illustrated) of the pressing members 61.

The developing cartridge 13 is mounted in the drum unit 12, with its bosses 95 contacting the upper surface of the support portions 111 in the cartridge support parts 126. Thus, the developing cartridge 13 is supported by the cartridge support part 126, while being restricted from moving further downward.

In this state, each boss 95 is pressed by the corresponding pressing rod 72 in a direction to move the rubber roller 99 toward the photosensitive drum 14. However, the contact between the boss 95 and the upper surface of the support portion 111 restricts the developing cartridge 13 from moving, and thus restricts the rubber roller 99 from moving toward the photosensitive drum 14. The developing roller 18 is disposed as being spaced apart from the photosensitive drum 14.

In the manner described above, all the developing cartridges 13 are mounted in the drum unit 12 such that the developing rollers 18 of all the developing cartridges 13 are spaced apart from the corresponding photosensitive drums 14.

It is noted that the support portion 111 in the frontmost cartridge support part 126 for the black developing cartridge 13K is at a vertical level lower than the support portions 111 in the other cartridge support parts 126. So, when all the developing cartridges 13 are mounted in the drum unit 12, the black developing cartridge 13K is located at a vertical level lower than the other developing cartridges 13. The left and right ends of the developing roller shaft 98 in the black developing cartridge 13K are positioned in the guide grooves 52 at a vertical level lower than those of the developing roller shafts 98 in the other developing cartridges 13. So, the gap between the rubber roller 99 in the black developing cartridge 13K and the photosensitive drum 14 is smaller than the gaps between the rubber rollers 99 in the three-color developing cartridges 13YMC and the photosensitive drums 14.

At this stage, the left end surfaces of the coupling members 96 in the developing cartridges 13 are exposed through the insertion through-holes 118 of the second frame 101 as shown in FIG. 12.

(6) How to Contact Developing Cartridge to Photosensitive Drum and how to Separate Developing Cartridge from Photosensitive Drum Next will be described how to bring the developing cartridges 13 into and out of contact with the photosensitive drums 14.

Similarly to the first embodiment, the color laser printer 201 of the second embodiment can be switched between the monochrome mode and color mode.

In order to bring the developing cartridges 13 in and out of contact with the photosensitive drums 14, the second frame 101 is moved relative to the first frame 21 in the vertical direction in a state where the process unit 9 is mounted in the main casing 2.

In order to move the second frame 101 downward relative to the first frame 21, the pressing portions 227 are controlled to advance downward so that the pressing portions 227 abut against the front side pressed portions 130 and the rear side pressed portions 131 of the second frame 101. This urges the second frame 101 to move downward against the urging force of the spring members 290, as illustrated in FIGS. 14 and 15. As a result, the second frame 101 moves downward relative to the first frame 21.

In order to move the second frame 101 upward relative to the first frame 21, the pressing portions 227 are retracted upward to release the contact between the pressing portions 227 and the front and rear side pressed portions 130 and 131 as illustrated in FIG. 13. As a result, the second frame 101 is urged upward by the spring members 290. The second frame 101 moves upward relative to the first frame 101.

In such a manner as described above, each developing cartridge 13 can be moved between the contact position and the separate position.

Similarly to the first embodiment, the second frame 101 can be located at any of the all-separate position, the monochrome image-forming position, and the multicolor image-forming position depending on the amount of the pressing force (advancing distance) of the pressing portions 227.

(6-1) All-Separate Position

When the pressing portions 227 are at their standby position, the pressing portions 227 are separate away from the front and rear side pressed portions 130 and 131, as illustrated in FIG. 13. So, the second frame 101 is urged upward by the spring members 290, and is located at the all-separate position. The all-separate position is the uppermost position among the all-separate position, the monochrome image-forming position, and the multicolor image-forming position.

At this stage, as described above, the bosses 95 of all the developing cartridges 13 contact the upper surfaces of the support portions 111 in the cartridge support parts 126. So, the developing cartridge 13 are supported by the cartridge support parts 126.

The boss 95 of each developing cartridge 13 is pressed by the pressing rod 72 of the pressing member 61. However, the developing cartridge 13 is restricted from moving because the boss 95 is in contact with the upper surface of the support portion 111. That is, the rubber roller 99 is restricted from moving toward the photosensitive drum 14.

The left end surfaces of the left side bearing fitting parts 50 are exposed through the drum exposing through-holes 117 of the second side plate 107 as being located on the lower sides in the drum exposing through-holes 117, as illustrated in FIG. 12. The left end surfaces of the coupling members 96 are exposed through the insertion through-holes 118 of the second side plate 107 as being located on the lower sides in the insertion through-hole 118.

(6-2) Monochrome Image-Forming Position

When the pressing portions 227 advance from the standby position to a first advancing position that is located at a vertical level lower than the standby position, the pressing portions 227 abut against the front and rear side pressed portions 130 and 131. As a result, as illustrated in FIG. 14, the pressing portions 227 press the second frame 101 downward against the urging force of the spring members 290. The second frame 101 moves downward from the all-separate position relative to the first frame 21.

When the second frame 101 moves downward relative to the first frame 21, the cartridge support parts 126 and the pressing members 61 move downward together with the second frame 101. Each developing cartridge 13 moves downward together with the second frame 101 until its developing roller shaft 98 reaches the lowermost portion in the guide grooves 52 and the rubber roller 99 contacts the photosensitive drum 14.

Before the pressing portions 227 reach the first advancing position, the developing roller shaft 98 of the black developing cartridge 13K reaches the lowermost portion in the guide grooves 52 and the rubber roller 99 of the black developing cartridge 13K contacts the photosensitive drum 14. Thus, the black developing cartridge 13K is located in the contact position. As a result, the black developing cartridge 13K stops moving downward. However, the second frame 101 continues moving downward until the pressing portions 227 reach the first advancing position. As a result, the bosses 95 of the black developing cartridge 13K separate away from the support portions 111 by moving upwardly relative to the second frame 101. When the pressing portions 227 reach the first advancing position, that is, when the second frame 101 reaches the monochrome image-forming position, the black developing cartridge 13K is located in the contact position, with its bosses 95 being separate from the support portions 111.

Because the contact between the bosses 95 and the support portions 111 is released, the pressing rods 72 press the bosses 95 by the urging force of the urging members (not illustrated) in the pressing members 61 in a lower-rear direction, that is, in a direction to move the rubber roller 99 of the black developing cartridge 13K toward the photosensitive drum 14.

Thus, at the contact position, the black developing cartridge 13K is positioned relative to the first frame 21 in, a direction in which the black developing cartridge 13K moves toward the photosensitive drum 14.

On the other hand, the developing roller shafts 98 of the other developing cartridges 13 have not yet reached the lowermost portion in the guide grooves 52. This is because the support portions 111 of the cartridge support parts 126 for the three-color developing cartridges 13YMC are at the vertical level higher than those of the cartridge support parts 126 for the black developing cartridge 13K. The rubber rollers 99 of the three-color developing cartridges 13YMC are therefore still in the separate position. The gaps between the rubber rollers 99 of the three-color developing cartridges 13YMC and the photosensitive drums 14 in the monochrome image-forming position are smaller than the gaps between the rubber rollers 99 of the three-color developing cartridges 13YMC and the photosensitive drums 14 in the all-separate position. The bosses 95 of the three-color developing cartridges 13YMC are still in contact with the support portions 111.

(6-3) Multicolor Image-Forming Position

When the pressing portions 227 further advance from the first advancing position to a second advancing position that is located at a vertical level lower than the first advancing position, the second frame 101 moves downward from the monochrome image-forming position, as illustrated in FIG. 15.

When the second frame 101 moves downward from the monochrome image-forming position, the three-color developing cartridges 13YMC move downward while being supported by the support portions 111.

Before the pressing portions 227 reach the second advancing position, the developing roller shafts 98 of the three-color developing cartridges 13YMC reach the lowermost portion in the guide grooves 52 and the rubber rollers 99 of the three-color developing cartridges 13YMC contact the photosensitive drums 14. In this manner, the three-color developing cartridges 13YMC are located at the contact positions.

After the rubber rollers 99 of the three-color developing cartridges 13YMC thus contact the photosensitive drums 14, the second frame 101 further moves downward until the pressing portions 227 finally reach the second advancing position. As a result, the bosses 95 of the three-color developing cartridges 13YMC separate away from the support portions 111. When the pressing portions 227 reach the second advancing position, that is, when the second frame 101 reaches the multicolor image-forming position, all the developing cartridges 13 are located in the contact positions, with their bosses 95 being separate from the support portions 111. In this state, the pressing members 61 press the bosses 95 of all the developing cartridges 13 to move the developing rollers 18 toward the photosensitive drums 14.

When the second frame 101 is at the multicolor image-forming position, as denoted by double-dotted lines in FIG. 12, the left end surfaces of the left side bearing fitting parts 50 are positioned on the upper side in the drum exposing through-holes 117. The left end surfaces of the coupling members 96 are positioned on the upper side in the insertion through-hole 118.

It is noted that similarly to the first embodiment, the pressing rods 72 extend in a direction intersecting with both of the front-to-rear direction and the vertical direction. So, the pressing rods 72 can rotate in the clockwise direction when seen from a left side if the bosses 95 press the pressing rods 72 in the upper-front direction against the urging force of the urging members (not illustrated) provided in the pressing members 61. In this way, the pressing rods 72 can allow the second frame 101 to move downwardly and upwardly relative to the first frame 21, and can still press the bosses 95 in a direction to move the rubber rollers 99 toward the photosensitive drums 14.

6. Operations (1) The second frame 101 is attached to the first frame 21 so as to be movable relative to the first frame 21 in the vertical direction. By moving the second frame 101 relative to the first frame 21 in the vertical direction, each developing cartridge 13 can be moved between the contact position and the separate position. Thus, the plurality of developing cartridges 13 can be moved between the separate positions and the contact positions by merely moving the second frame 101. The number of components constituting the process unit 9 can be reduced.

(2) The second frame 101 includes the cartridge support parts 126. Each cartridge support part 126 includes the support portion 111. When the developing cartridge 13 is in the separate position, the developing cartridge 13 is supported by the support portion 111. This maintains the rubber roller 99 to be separate from the photosensitive drum 14 with accuracy.

(3) The process unit 9 includes the spring members 290. The spring members 290 are mounted on the front side spring mounting portions 103 and rear side spring mounting portions 106 of the first frame 21. The spring members 290 abut against the front side spring-pressed portions 123 and rear side spring-pressed portions 124 of the second frame 101, thereby urging the second frame 101 upward.

In this manner, the second frame 101 is always urged by the spring members 290 in a direction to position all the developing cartridges 13 at the separate positions. This can prevent deformation of the rubber rollers 99 that will possibly occur when the color laser printer 201 or the process unit 9 is transported for shipping or is stored before shipping.

The pressing portions 227 can press the front and rear side pressed portions 130 and 131 of the second frame 101 when the process unit 9 is mounted in the main casing 2. Thus, the second frame 101 can be pressed downward against the urging force of the spring members 290. With this configuration, the developing cartridges 13 can be moved from the separate positions to the contact positions as needed to bring the rubber rollers 99 into contact with the photosensitive drums 14.

(4) When a developing cartridge 13 is at the separate position, the support portion 111 of the corresponding cartridge support part 126 contacts the lower portion of the boss 95, thereby restricting the developing cartridge 13 from moving even though the pressing member 61 presses the boss 95. On the other hand, when the developing cartridge 13 is at the contact position, the support portion 111 is separate away from the boss 95 to allow the developing cartridge 13 to move in accordance with the pressing member 61 pressing the boss 95.

Thus, when the developing cartridge 13 is at the separate position, it is ensured that the rubber roller 99 is separate away from the photosensitive drum 14 with accuracy. When the developing cartridge 13 is at the contact position, stable contact between the rubber roller 99 and the photosensitive drum 14 is ensured.

(5) The support portion 111 for the black developing cartridge 13K is positioned on the lower side in the vertical direction than the support portions 111 for the three-color developing cartridges 13YMC. In other words, the support portion 111 for the black developing cartridge 13K is positioned on the downstream side in the pressing direction of the pressing portions 227 than the support portions 111 for the three-color developing cartridges 13YMC.

This simple configuration allows only the black developing cartridge 13K to be located at the contact position when the second frame 101 is at the monochrome image-forming position.

(6) The pressing rod 72 extends in the direction intersecting with both the front-to-rear direction and the vertical direction. More specifically, the pressing rod 72 is inclined to extend upward toward the rear. Thus, the pressing rod 72 intersects with a direction, in which the second frame 101 moves relative to the first frame 21 (vertical direction). So, the pressing rod 72 can press the boss 95, while allowing the second frame 101 to move in the vertical direction relative to the first frame 21. Even with the simple configuration, it is ensured that the second frame 101 is moved relative to the first frame 21 in the vertical direction.

While the invention has been described in detail with reference to the embodiments thereof, it would be apparent to those skilled in the art that various changes and modifications may be made therein without departing from the spirit of the invention.

For example, in the first embodiment, the lower-edge guide grooves 100 may not be formed in the first side plates 37. The protruding wall 104 may not be formed on the front beam 38.

What is claimed is:

1. An image forming apparatus, comprising:

a first frame, a plurality of photosensitive bodies being mounted in the first frame such that the photosensitive bodies are juxtaposed with one another, a plurality of developing units being detachably mountable in the first frame in correspondence with the photosensitive bodies; and a second frame that is movable relative to the first frame, wherein each developing unit of the developing units includes a respective developing roller configured to confront a corresponding photosensitive body of the photosensitive bodies, wherein each developing unit is movable relative to the first frame between a respective separated position, at which the respective developing roller is separate from the corresponding photosensitive body, and a respective contact position, at which the respective developing roller is in contact with the corresponding photosensitive body, wherein the second frame is configured to move relative to the first frame, thereby moving the developing units relative to the first frame between the separated positions and the contact positions, wherein the second frame is configured such that when at least one developing unit is at the respective contact position, the second frame positions each of the at least one developing unit relative to the first frame in a direction to move the corresponding developing roller toward the corresponding photosensitive body, and wherein the second frame includes:

a support portion configured such that when the at least one developing unit is in the respective separated position, the support portion supports each of the at least one developing unit; and a pressing member configured such that when the at least one developing unit is in the respective contact position, the pressing member presses each of the at least one developing unit in the direction to move the respective developing roller toward the corresponding photosensitive body.

2. The image forming apparatus as claimed in claim 1, further comprising:

an urging part that is configured to urge the second frame in a direction to bring the developing units into the separated positions; and a pressing part that is configured to press the second frame, against an urging force by the urging part, along a direction in which the second frame is movable relative to the first frame, to thereby bring the developing units into the contact positions.

3. The image forming apparatus as claimed in claim 2, wherein the second frame is configured to be located at one of an all-separate position, a monochrome image-forming position, and a multicolor image-forming position depending on an amount of a pressing force by the pressing part, wherein, when the second frame is in the all-separate position, all of the developing units are located at the separated positions, wherein, when the second frame is in the monochrome image-forming position, one developing unit is located at the respective contact position, and another developing unit is located at the respective separated position, and wherein, when the second frame is in the multicolor image-forming position, all of the developing units are located at the contact positions.

4. The image forming apparatus as claimed in claim 1, wherein the support portion includes a plurality of support portions, wherein each developing unit includes a respective projection portion configured to be pressed by the pressing member, wherein, when a developing unit of the developing units is at the respective separate position, a corresponding support portion contacts the respective projection portion, thereby restricting movement of the developing unit that is caused by the pressing member pressing the respective projection portion, and wherein, when the developing unit is at the respective contact position, the corresponding support portion is separated away from the respective projection portion to allow the developing unit to move in accordance with the pressing member pressing the respective projection portion.

5. The image forming apparatus as claimed in claim 3, wherein the support portion includes a plurality of support portions, and wherein a corresponding support portion, for a developing unit that is located at the respective contact position when the second frame is in the monochrome image-forming position, is shorter than a corresponding support portion for another developing unit in a pressing-part pressing direction in which the pressing part presses the second frame.

6. The image forming apparatus as claimed in claim 3, wherein the support portion includes a plurality of support portions, and wherein a corresponding support portion, for a developing unit that is located at the respective contact position when the second frame is in the monochrome image-forming position, is positioned on a downstream side of a corresponding support portion for another developing unit in a pressing-part pressing direction in which the pressing part presses the second frame.

7. The image forming apparatus as claimed in claim 2, wherein the pressing member extends in a direction that intersects with a pressing-part pressing direction, in which the pressing part presses the second frame, and a direction perpendicular to the pressing-part pressing direction.

8. A process unit, comprising:

a first frame, a plurality of photosensitive bodies being mounted in the first frame such that the photosensitive bodies are juxtaposed with one another, a plurality of developing units being detachably mountable in the first frame in correspondence with the photosensitive bodies; and a second frame that is movable relative to the first frame, wherein each developing unit of the developing units includes a respective developing roller that is configured to confront a corresponding photosensitive body of the photosensitive bodies, wherein each developing unit is movable relative to the first frame between a respective separated position, at which the developing roller is separate from the corresponding photosensitive body, and a contact position, at which the developing roller is in contact with the corresponding photosensitive body, wherein the second frame is configured to move relative to the first frame, thereby moving the developing units relative to the first frame between the separate positions and the contact positions, wherein the second frame is configured such that when at least one developing unit is at the contact position, the second frame positions each of at least one developing unit relative to the first frame in a direction to move the corresponding developing roller toward the corresponding photosensitive body, and wherein the second frame includes:

a support portion configured such that when the at least one developing unit is in the respective separated position, the support portion supports each of the at least one developing unit; and a pressing member configured such that when at least one developing unit is in the respective contact position, the pressing member presses each of the at least one developing unit in the direction to move the respective developing roller toward the corresponding photosensitive body.

9. The process unit as claimed in claim 8, further comprising an urging part that is configured to urge the second frame in a direction to bring the developing units into the separated positions.

10. An image forming apparatus, comprising:

a first frame, a plurality of photosensitive bodies being mounted in the first frame such that the photosensitive bodies are juxtaposed with one another, a plurality of developing units being detachably mountable in the first frame in correspondence with the photosensitive bodies; and a second frame that is movable relative to the first frame;

wherein each developing unit of the developing units includes a respective developing roller configured to confront a corresponding photosensitive body of the photosensitive bodies, wherein each developing unit is movable relative to the first frame between a respective separate position, at which the respective developing roller is separate from the corresponding photosensitive body, and a respective contact position, at which the respective developing roller is in contact with the corresponding photosensitive body, wherein the second frame is configured to move the developing units relative to the first frame between the separated positions and the contact positions, wherein the second frame is configured such that when at least one developing unit is at the contact position, the second frame positions each of the at least one developing unit relative to the first frame in a direction to move the corresponding developing roller toward the corresponding photosensitive body, and wherein the second frame includes:

a support portion configured such that when at least one developing unit is in the respective separated position, the support portion supports each of the at least one developing unit; and a pressing member configured such that when at least one developing unit is in the respective contact position, the pressing member presses each of the at least one developing unit in the direction to move the respective developing roller toward the corresponding photosensitive body.

11. A process unit, comprising:

a first frame, a plurality of photosensitive bodies being mounted in the first frame such that the photosensitive bodies are juxtaposed with one another, a plurality of developing units being detachably mountable in the first frame in correspondence with the photosensitive bodies; and a second frame that is movable relative to the first frame;

wherein each developing unit of the developing units includes a respective developing roller that is configured to confront a corresponding photosensitive body of the photosensitive bodies, wherein each developing unit is movable relative to the first frame between a respective separated position, at which the developing roller is separate from the corresponding photosensitive body, and a contact position, at which the developing roller is in contact with the corresponding photosensitive body, wherein the second frame is configured to move the developing units relative to the first frame between the separated positions and the contact positions, wherein the second frame is configured such that when at least one developing unit is at the contact position, the second frame positions each of the at least one developing unit relative to the first frame in a direction to move the corresponding developing roller toward the corresponding photosensitive body, and wherein the second frame includes:

a support portion configured such that when the at least one developing unit is in the respective separated position, the support portion supports each of the at least one developing unit; and a pressing member configured such that when the at least one developing unit is in the respective contact position, the pressing member presses each of the at least one developing unit in the direction to move the respective developing roller toward the corresponding photosensitive body.

* * * * *